US010677157B2

(12) United States Patent
Chottiner et al.

(10) Patent No.: US 10,677,157 B2
(45) Date of Patent: Jun. 9, 2020

(54) VARIABLE COMPRESSION RATIO ENGINE WITH MECHANICAL LOCKING PIN

(71) Applicant: Ford Global Technologies, LLC, Dearborn, MI (US)

(72) Inventors: Jeffrey Chottiner, Farmington Hills, MI (US); John Edward Brevick, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 90 days.

(21) Appl. No.: 16/124,585

(22) Filed: Sep. 7, 2018

(65) Prior Publication Data

US 2020/0080473 A1 Mar. 12, 2020

(51) Int. Cl.

| | |
|---|---|
| ***F02B 75/04*** | (2006.01) |
| ***F02D 15/02*** | (2006.01) |
| ***F02B 75/32*** | (2006.01) |

(52) U.S. Cl.

CPC ..... *F02B 75/048* (2013.01); *F02B 75/045* (2013.01); *F02B 75/32* (2013.01); *F02D 15/02* (2013.01); *F02B 75/04* (2013.01); *F02D 2200/101* (2013.01)

(58) Field of Classification Search

CPC ..... F02B 75/048; F02B 75/045; F02B 75/32; F02B 75/04; F02D 15/02; F02D 2200/101; F01M 11/03

USPC ..... 123/48 B

See application file for complete search history.

(56) References Cited

U.S. PATENT DOCUMENTS

| | | | | |
|---|---|---|---|---|
| 7,059,280 | B2 | 6/2006 | Nohara et al. | |
| 10,400,668 | B2 * | 9/2019 | Hiyoshi | F02B 75/04 |
| 2009/0107454 | A1 * | 4/2009 | Hiyoshi | F02B 75/048 123/197.4 |
| 2013/0306035 | A1 * | 11/2013 | Hiyoshi | F02B 75/047 123/48 B |

FOREIGN PATENT DOCUMENTS

| | | |
|---|---|---|
| CN | 205638695 U | 10/2016 |
| JP | 2003322036 A | 11/2003 |
| JP | 2010151088 A | 7/2010 |

* cited by examiner

*Primary Examiner* — Syed O Hasan

(74) *Attorney, Agent, or Firm* — Geoffrey Brumbaugh; McCoy Russell LLP

(57) ABSTRACT

Methods and systems are provided for a VCR engine. In one example, the VCR engine includes a VCR mechanism that relies on electric power to adjust a compression ratio of the VCR engine. The compression ratio is maintained by hydraulically-assisted engagement of a mechanical locking pin with an S-link of the VCR mechanism, holding a position of the VCR mechanism while an electric motor, used to adjust a position of the S-link, may be deactivated.

20 Claims, 9 Drawing Sheets

VARIABLE COMPRESSION RATIO ENGINE WITH MECHANICAL LOCKING PIN

FIELD

The present description relates generally to methods and systems for a variable compression ratio engine.

BACKGROUND/SUMMARY

In a conventional vehicle engine, a cylinder compression ratio (CR) is fixed, with a piston moving between a consistent top-dead-center (TDC) and bottom-dead-center (BDC) during each combustion cycle. If the CR is set at a low ratio to deliver maximum power during engine operation, the low CR may result in undesirable combustion of excess fuel during light engine loads and speeds. Conversely, if the CR is set at a high ratio to prioritize fuel efficiency, a power output of the engine may be degraded when increased torque is requested.

To mitigate the above issues, an engine may be adapted as variable compression ratio (VCR) engine and equipped with various mechanisms to alter (e.g., mechanically) a volumetric ratio between the piston TDC and BDC. Thus the CR may be adjusted as engine operating conditions change. As a non-limiting example, a VCR engine may be configured with a mechanical piston displacement changing device (e.g., an eccentric) that moves the piston closer to or further from the cylinder head, thereby changing the size of the combustion chambers. Still other engines may mechanically alter a cylinder head volume.

VCR engines may allow increased fuel efficiency over conventional engine systems with fixed CRs. However, when the CR is adjusted in a VCR engine, maintaining the mechanism in a position to sustain operation at a given CR may include operating an electric motor to brace the mechanism against forces arising from combustion and inertia that would otherwise change the position of the VCR device. Although the VCR engine may provide increases in fuel economy of 3-4%, activation of the motor to maintain the CR may at least partially offset the fuel economy benefits.

Attempts to address the additional fuel consumed by the electric motor while maintaining the CR may include configuring the VCR mechanism with a device to hold the desired CR without use of the motor. One example approach is shown by Aoyama et al. in Japanese Patent Application No. JP 2003322036. Therein, a VCR mechanism comprises multiple linkages connecting a piston and crankshaft to a rotatable control shaft. Rotation of the control shaft is controlled by an electric motor and the rotation varies the CR. When a command to alter the CR is detected, the electric motor adjusts the control shaft until a desired CR is attained. A hydraulic retention device is actuated to hold the position of the control shaft based on oil pressure in the device. The electric motor may be deactivated until the CR is to be varied, thus decreasing energy directed towards operating the motor.

However, the inventors herein have recognized potential issues with such systems. The CR of the engine is maintained entirely based on hydraulic pressure. During engine operation, the piston motion exerts force directly on the control shaft, which may transmitted to the hydraulic retention device, thereby requiring the device to absorb vibrations and fluctuations in pressure and temperature in order to retain the position of the control shaft. Absorption of such forces may accelerate degradation of the VCR mechanism components. Furthermore, the hydraulic retention device may be prone to slippage when fluctuations in oil pressure occur. Slipping of the retention device may lead to undesirable deviation of the CR from the target CR.

In one example, the issues described above may be addressed by a variable compression ratio (VCR) mechanism comprising an S-link including a plurality of apertures and coupled to a control shaft and attached to an electric motor, a locking pin configured to alternate between a first position and a second position, the locking pin inserted through an aperture of the plurality of apertures when in the first position, and a hydraulic device configured to selectively maintain the locking pin in the first position. In this way, the CR may be varied by an electric actuator and held in place without consuming energy via a hydraulically-actuated mechanical pin.

As one example, the VCR mechanism includes an S-shaped link, configured with a plurality of apertures, coupled to a control shaft of the VCR engine. Rotation of the shaft is achieved by an electric actuator, the electric actuator adjusting a position of the link relative to the control shaft, thereby rotating the control shaft and altering piston heights within combustion chambers of the VCR engine. Altering the piston heights results in adjustment of the CR. The position of the link is sustained by a locking pin that is inserted in an aperture of the plurality of apertures. Movement of the locking pin is controlled by a two-position valve that varies hydraulic pressure within the VCR mechanism to alter a position of the locking pin. In this way, the VCR mechanism may maintain a piston of the VCR engine at a target CR without relying on an active electric motor.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-5 and 10A-11B are shown approximately to scale.

DETAILED DESCRIPTION

Figure 1:
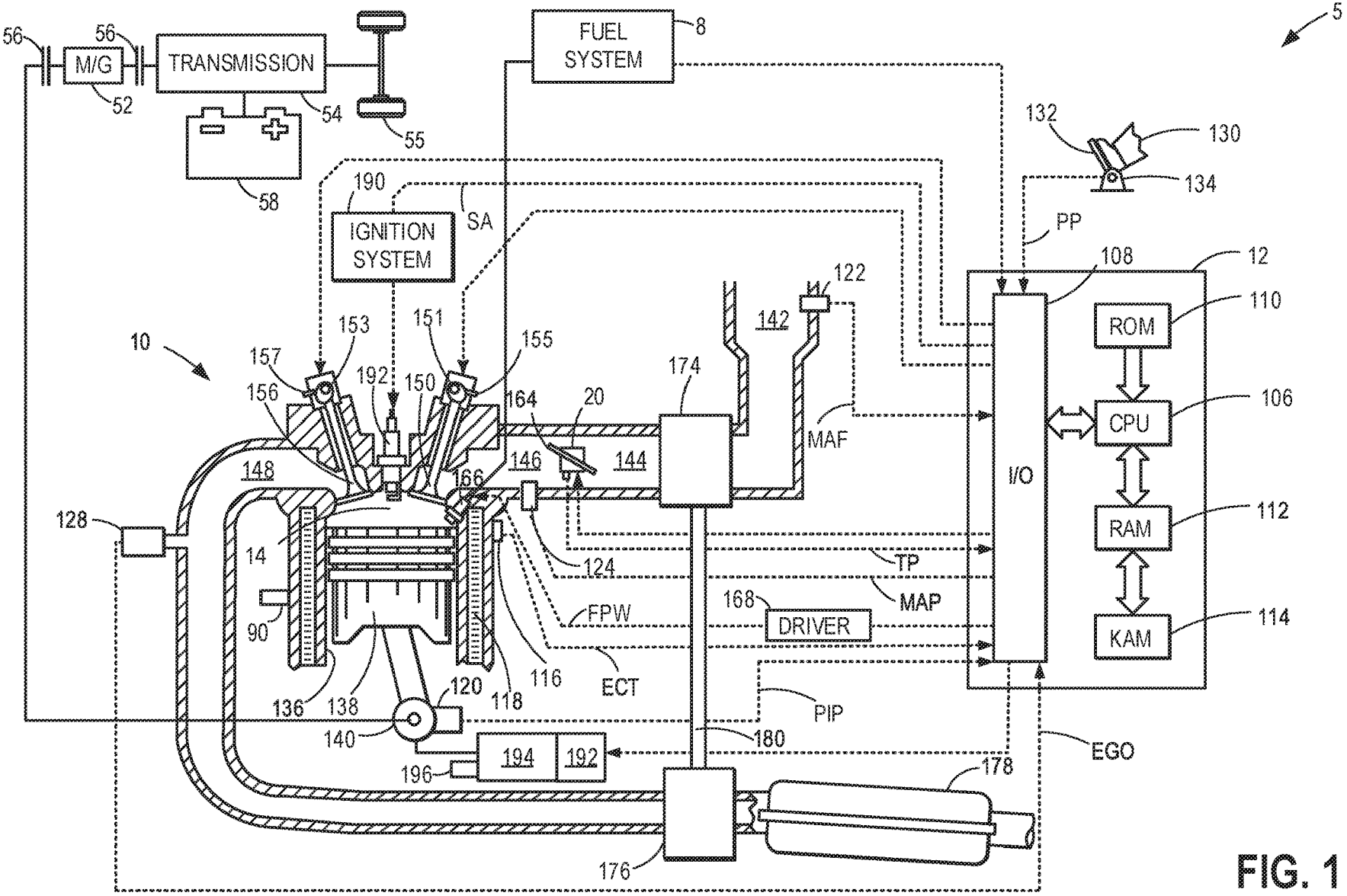
FIG. 1 shows an example of an engine system in which a compression ratio may be varied by a variable compression ratio (VCR) mechanism.
Figure 3:
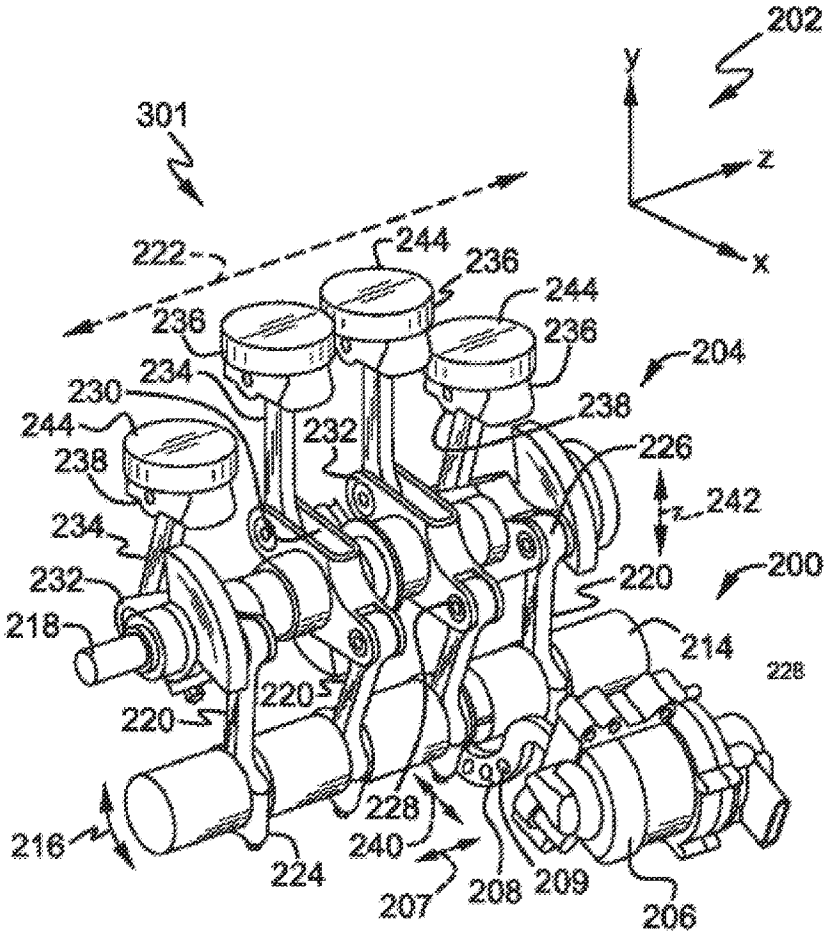
FIG. 3 shows a perspective view of an example of the VCR mechanism coupled to pistons of the VCR engine.
Figure 2:
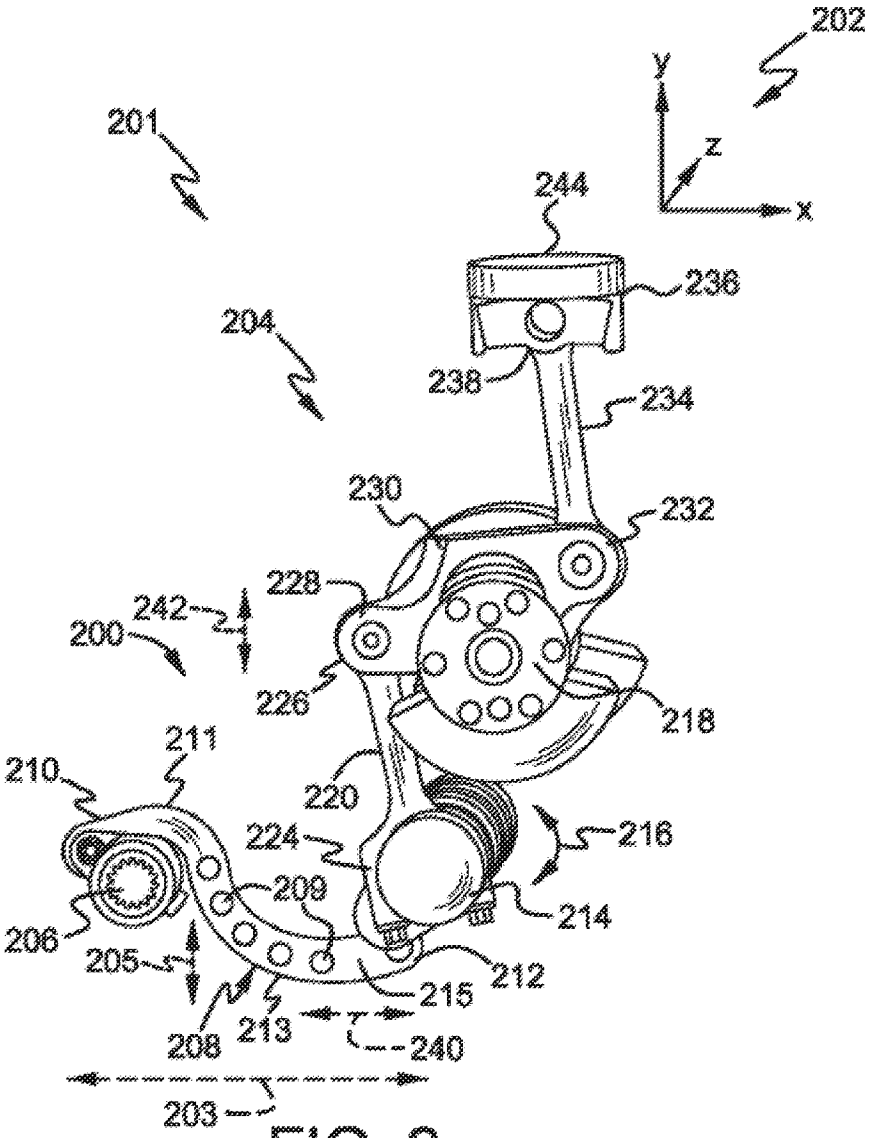
FIG. 2 shows a side view of an example of a VCR mechanism that may be used in a VCR engine.
Figure 5:
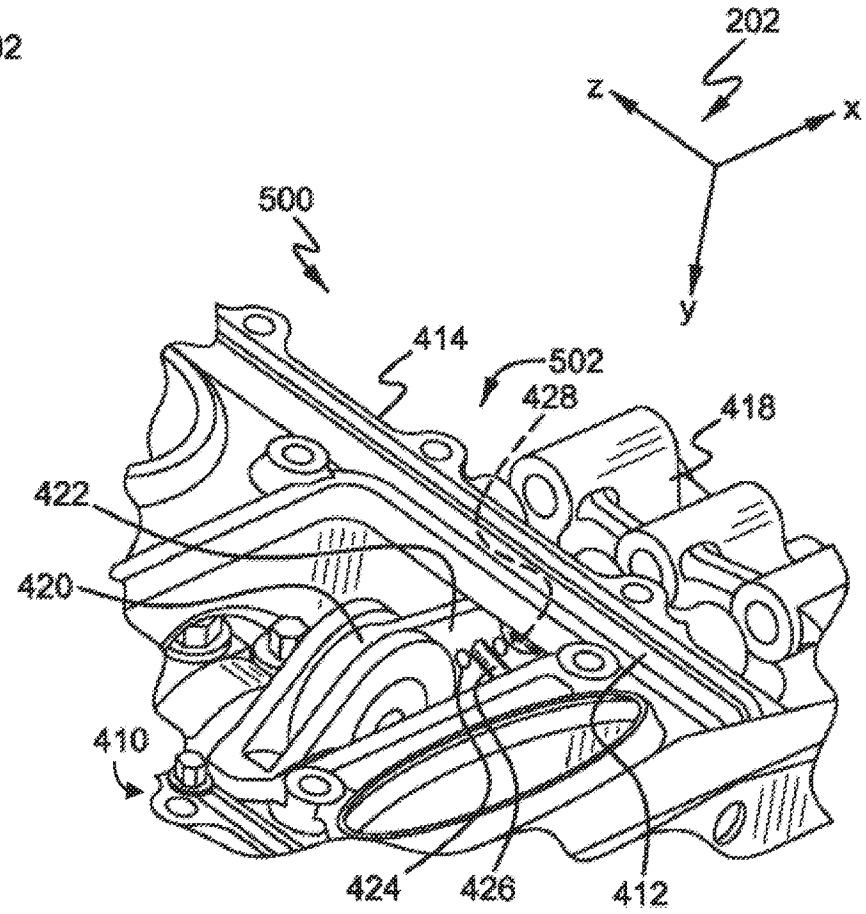
FIG. 5 shows a view of a bottom of the VCR engine with an oil pan removed.
Figure 4:
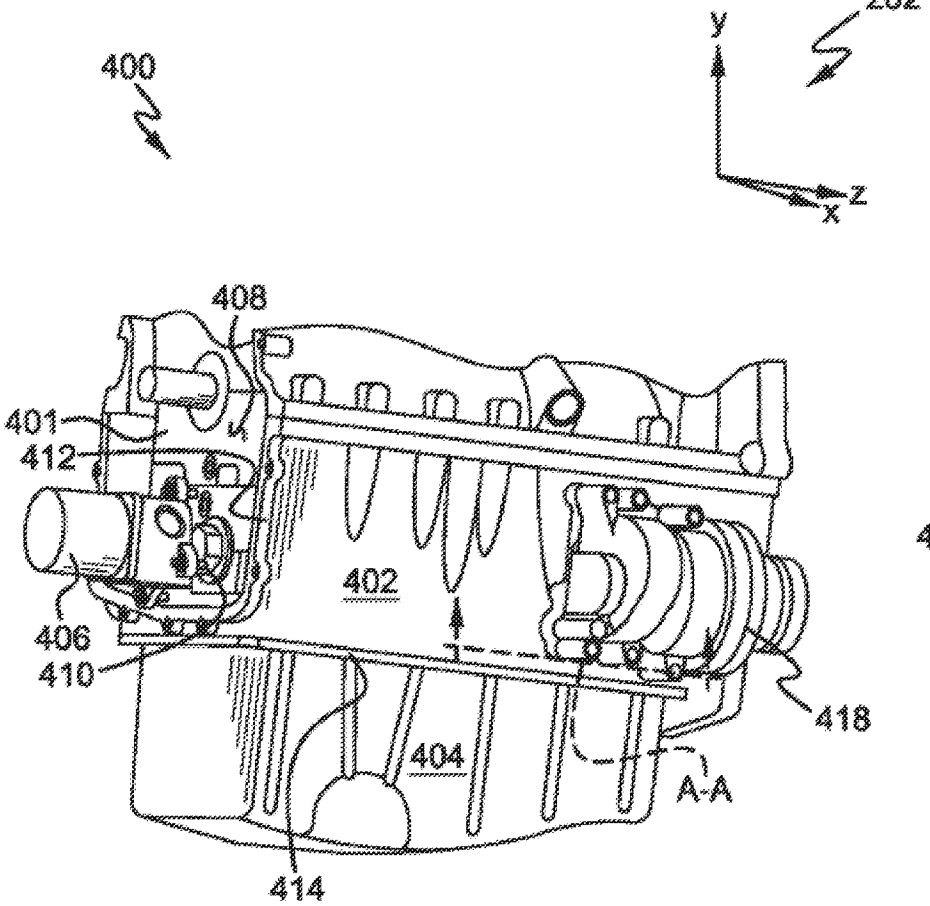
FIG. 4 shows a perspective view of an exterior of an example of the VCR mechanism coupled to the VCR engine.

The following description relates to systems and methods for a variable compression ratio (VCR) engine. The VCR engine may increase vehicle fuel economy by allowing a compression ratio of the engine to be varied as engine operating conditions change. The compression ratio may be adjusted to provide an engine power output that matches a torque demand while decreasing a likelihood of engine knock and increasing a fuel economy of the engine during low engine loads and speeds. An engine system that may include the VCR engine is shown in FIG. 1. In FIG. 2, a profile view is shown of a VCR mechanism, including an S-shaped link, a locking pin, a control shaft, and a plurality of arms coupling the control shaft to an engine crankshaft, which may be used to vary the compression ratio. The VCR mechanism may be coupled to an electric actuator that controls movement of the link, thereby changing the compression ratio of the engine. A coupling of the link and control shaft to a crankshaft and pistons of the VCR engine is illustrated in FIG. 3. Positioning of oil pans and the actuator relative to an engine block of the VCR engine is shown in FIG. 4, providing a view of an exterior of the VCR engine. A view from a bottom side of the VCR engine is depicted in FIG. 5 with a lower oil pan removed to show a positioning of the link and control shaft within the engine. The link may be adapted with a plurality of apertures, each aperture corresponding to a compression ratio of the pistons, through which a locking pin may be inserted to maintain a position of the link relative to the control shaft. Movement of the locking pin may be controlled by a two-position valve that adjusts a hydraulic pressure within the VCR mechanism. A coupling of the two-position valve to the VCR mechanism is illustrated in a first schematic diagram in FIG. 6 and a second schematic diagram in FIG. 7. The VCR mechanism and the two-position valve may be adjusted between a first position (shown in FIG. 6) and a second position (shown in FIG. 7) that controls flow of oil to and from the VCR mechanism. The flow of oil moderates a hydraulic pressure in the VCR mechanism to alter a position of the pin between engaging with the link to maintain the CR or releasing the link to vary the CR. Management of the engine compression ratio via the VCR mechanism during engine operation is described in an example of a method for varying the compression ratio according to engine operating conditions in FIG. 8. Example operations of elements of the VCR mechanism in response to engine load and charging is shown in a timeline diagram of FIG. 9. Adjustment of the VCR mechanism to alter piston height, and thus the CR of the engine, is illustrated in FIGS. 10A-10C, showing the VCR mechanism in three different positions corresponding to different CRs. An arrangement of the VCR mechanism with respect to a crankshaft of the VCR engine is depicted in FIG. 11A. FIG. 11A includes an expanded view of the VCR mechanism, shown in FIG. 11B, to illustrate where the locking pin of the VCR mechanism may be positioned relative to the link and control shaft.

FIGS. 1-7 and 10A-11B show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example FIG. 1 depicts an example embodiment of a combustion chamber (herein, also referred to as "cylinder") 14 of an internal combustion engine 10, which may be included in a passenger vehicle 5. Engine 10 may receive control parameters from a control system, including a controller 12, and input from a vehicle operator 130 via an input device 132. In this example, input device 132 includes an accelerator pedal and a pedal position sensor 134 for generating a proportional pedal position signal PP. Cylinder 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one vehicle wheel 55 of the passenger vehicle via a transmission system 54. Further, a starter motor may be coupled to crankshaft 140 via a flywheel to enable a starting operation of engine 10.

Engine 10 may be configured as a VCR engine wherein the compression ratio (CR) of each cylinder—a ratio of a cylinder volume when the piston is at bottom-dead-center (BDC) to a cylinder volume when the piston is at top-dead-center (TDC)—can be mechanically altered. The CR of the engine may be varied via a VCR actuator 192 actuating a VCR mechanism 194. VCR actuator 192 may be an electric motor, configured to engage with the VCR mechanism 194. In some examples, the CR may be varied between a first, lower CR (wherein the ratio of the cylinder volume when the piston is at BDC to the cylinder volume when the piston is at TDC is smaller) and a second, higher CR (wherein the ratio is higher). In still other examples, there may be predefined number of stepped compression ratios between the first, lower CR and the second, higher CR. Further still, the CR may be continuously variable between the first, lower CR and the second, higher CR (to any CR in between).

In the depicted example, VCR mechanism 194 is coupled to piston 138 such that the VCR mechanism may change the piston TDC position. For example, piston 138 may be coupled to crankshaft 140 via VCR mechanism 194, which may be a piston position changing mechanism that moves the piston closer to or further from the cylinder head, thus changing the position of the piston and thereby the size of combustion chamber 14. A position sensor 196 may be coupled to the VCR mechanism 194 and may be configured to provide feedback to controller 12 regarding the position of VCR mechanism 194 (and thereby the CR of the cylinder).

In one example, changing the position of the piston within the combustion chamber also changes the relative displacement of the piston within the cylinder. The piston position changing VCR mechanism may be coupled to a conventional cranktrain or an unconventional cranktrain. Non-limiting examples of an unconventional cranktrain to which the VCR mechanism may be coupled includes variable distance head crankshafts and variable kinematic length crankshafts. In one example, crankshaft 140 may be configured as an eccentric shaft. In another example, an eccentric may be coupled to, or in the area of, a piston pin, with the eccentric changing the position of the piston within the combustion chamber. Movement of the eccentric may be controlled by oil passages in the piston rod.

It will be appreciated that still other VCR mechanisms that mechanically alter the compression ratio may be used. For example, the CR of the engine may be varied via a VCR mechanism that changes a cylinder head volume (that is, the clearance volume in the cylinder head). In other examples, alternate methods of changing the cylinder head volume via an independent device may be used in conjunction with the VCR mechanism to obtain a desired CR.

As one example, the VCR mechanism 194 may include an S-shaped link (hereafter, S-link), coupled to a control shaft. The control shaft is rotatable and connected to the crankshaft 140 by a plurality of linking arms. The crankshaft 140 may, in turn, be connected to piston 138 by a connecting rod and rotation of the control shaft rocks a flange bearing coupled to the crankshaft. The flange bearing is linked to the piston by a connecting rod so that tilting of the flange bearing adjusts a height (e.g. distance between a top of piston 138 and a cylinder head) of the piston 138 within the cylinder 14. Movement of the S-shaped link, as directed by VCR actuator 192, may rotate the control shaft, thus varying the height of the piston 138 and the CR. The S-link may be adapted with a plurality of apertures through which a locking pin may be inserted. The VCR mechanism 194 may be coupled to a two-position valve (TPV) that flows oil in and out of the VCR mechanism 194 providing hydraulic pressure to compel sliding of the locking pin either into a first position that maintains a CR of the engine, with VCR actuator 192 deactivated, or into a second position that releases the VCR mechanism 194 and allows the CR to be varied. Further details of the VCR mechanism 194 and TPV will be discussed below with reference to FIGS. 2-8.

It will be appreciated that as used herein, the VCR engine may be configured to adjust the CR of the engine via mechanical adjustments that vary a piston position or a cylinder head volume. As such, VCR mechanisms do not include CR adjustments achieved via adjustments to intake/exhaust valve timing or cam timing.

By adjusting the position of the piston within the cylinder, an effective (static) compression ratio of the engine (e.g., a difference between cylinder volumes at TDC relative to BDC) can be varied. In one example, reducing the compression ratio includes reducing a displacement of the piston within the combustion chamber by increasing the distance between the top of the piston from the cylinder head. For example, the engine may be operated at a first, lower compression ratio by the controller sending a signal to VCR actuator 192 to actuate VCR mechanism 194 to a first position where the piston has a smaller effective displacement within the combustion chamber. As another example, the engine may be operated at a second, higher compression ratio by the controller sending a signal to VCR actuator 192 to actuate VCR mechanism 194 to a second position where the piston has a larger effective displacement within the combustion chamber. Changes in the engine compression ratio may be advantageously used to improve fuel economy. For example, the higher compression ratio may be used to improve fuel economy at light to moderate engine loads until spark retard from early knock onset erodes the fuel economy benefit. The engine can then be switched to the lower compression ratio, thereby trading off thermal efficiency for combustion phasing efficiency. In comparison, the lower compression ratio may be selected to improve performance at mid-high engine loads. Continuous VCR systems may continuously optimize the combustion phasing and the thermal efficiency to provide the best compression ratio between the higher compression ratio and lower compression ratio limits at the given operating conditions.

Returning to FIG. 1, cylinder 14 may receive intake air via a series of intake air passages 142, 144, and 146. Intake air passage 146 can communicate with other cylinders of engine 10 in addition to cylinder 14. In some embodiments, one or more of the intake passages may include a boosting device such as a turbocharger or a supercharger. For example, FIG. 1 shows engine 10 configured with a turbocharger, including a compressor 174 arranged between intake passages 142 and 144 and an exhaust turbine 176 arranged along an exhaust passage 148. As shown, compressor 174 may be at least partially powered by exhaust turbine 176 via a shaft 180. However, in other examples, such as where engine 10 is configured with a supercharger, exhaust turbine 176 may be optionally omitted, and compressor 174 may instead be powered by mechanical input from a motor of the engine.

A throttle 20, including a throttle plate 164, may be provided between intake air passage 144 and intake air passage 146 for varying the flow rate and/or pressure of intake air provided to the engine cylinders. For example, throttle 20 may be disposed downstream of compressor 174, as shown in FIG. 1, or may alternatively be provided upstream of compressor 174.

Exhaust passage 148 may receive exhaust gases from other cylinders of engine 10 in addition to cylinder 14. An exhaust gas sensor 128 is shown coupled to exhaust passage 148 upstream of an emission control device 178. Exhaust gas sensor 128 may be any suitable sensor for providing an indication of exhaust gas air-fuel ratio (AFR), such as a linear oxygen sensor or UEGO (universal or wide-range exhaust gas oxygen), a two-state oxygen sensor or EGO (as depicted), a HEGO (heated EGO), a NOx, a HC, or a CO sensor, for example. Emission control device 178 may be a three way catalyst (TWC), NOx trap, various other emission control devices, or combinations thereof.

Exhaust temperature may be estimated by one or more temperature sensors (not shown) located in exhaust passage 148. Alternatively, exhaust temperature may be inferred based on engine operating conditions such as engine speed, engine load, AFR, spark timing, etc. Further, exhaust temperature may be determined from one or more exhaust gas sensors 128. It may be appreciated that the exhaust gas temperature may alternatively be estimated by any combination of temperature estimation methods listed herein.

Each cylinder of engine 10 may include one or more intake valves and one or more exhaust valves. For example, cylinder 14 is shown including one intake poppet valve 150 and one exhaust poppet valve 156 located at an upper region of cylinder 14. In some embodiments, each cylinder of engine 10, including cylinder 14, may include at least two intake poppet valves and at least two exhaust poppet valves located at an upper region of the cylinder.

Intake valve 150 may be controlled by controller 12 by cam actuation via a cam actuation system 151. Similarly, exhaust valve 156 may be controlled by controller 12 via a cam actuation system 153. Cam actuation systems 151 and 153 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 150 and exhaust valve 156 may be determined by valve position sensors 155 and 157, respectively. In alternative embodiments, the intake and/or exhaust valve may be controlled by electric valve actuation. For example, cylinder 14 may alternatively include an intake valve controlled via electric valve actuation and an exhaust valve controlled via cam actuation, including CPS and/or VCT systems. In still other embodiments, the intake and exhaust valves may be controlled by a common valve actuator or actuation system or a variable valve timing actuator or actuation system.

Cylinder 14 may have an associated compression ratio, which, as described above, is the ratio of volumes when piston 138 is at BDC to TDC. Conventionally, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock. The compression ratio may also be varied based on driver demand via adjustments to the VCR actuator 192 that actuates the VCR mechanism 194, varying the effective position of piston 138 within combustion chamber 14. The compression ratio may be inferred based on feedback from sensor 196 regarding the position of the VCR mechanism 194.

In some embodiments, each cylinder of engine 10 may include a spark plug 192 for initiating combustion. An ignition system 190 may provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel, as may be the case with some diesel engines.

In some embodiments, each cylinder of engine 10 may be configured with one or more fuel injectors for providing fuel thereto. As a non-limiting example, cylinder 14 is shown including one fuel injector 166. Fuel injector 166 is shown coupled directly to cylinder 14 for injecting fuel directly therein in proportion to the pulse width of signal FPW received from controller 12 via electronic driver 168. In this manner, fuel injector 166 provides what is known as direct injection ("DI") of fuel into combustion cylinder 14. While FIG. 1 shows injector 166 as a side injector, injector 166 may also be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a high pressure fuel system 8, which may include one or more fuel tanks, fuel pumps, and a fuel rail. Alternatively, fuel may be delivered by a single stage fuel pump at lower pressure, in which case the timing of the direct fuel injection may be more limited during the compression stroke than if a high pressure fuel system is used. Further, while not shown, the one or more fuel tanks may have a pressure transducer providing a signal to controller 12. It will be appreciated that, in an alternate embodiment, injector 166 may be a port injector providing fuel into the intake port upstream of cylinder 14.

It will also be appreciated that while the depicted embodiment illustrates the engine being operated by injecting fuel via a single direct injector, in alternate embodiments, the engine may be operated by using two or more injectors (for example, a direct injector and a port injector per cylinder, or two direct injectors/two port injectors per cylinder, etc.) and varying a relative amount of injection into the cylinder from each injector.

Fuel may be delivered by the injector to the cylinder during a single cycle of the cylinder. Further, the distribution and/or relative amount of fuel delivered from the injector may vary with operating conditions. Furthermore, for a single combustion event, multiple injections fuel may be performed per cycle. The multiple injections may be performed during the compression stroke, intake stroke, or any appropriate combination thereof in what is known as split injection. Also, fuel may be injected during the cycle to adjust the air-fuel ratio (AFR) of the combustion. For example, fuel may be injected to provide a stoichiometric AFR. An AFR sensor may be included to provide an estimate of the in-cylinder AFR. In one example, the AFR sensor may be an exhaust gas sensor, such as EGO sensor 128. By measuring an amount of oxygen in the exhaust gas, which is higher for lean mixtures and lower for rich mixtures, the sensor may determine the AFR. As such, the AFR may be provided as a lambda ($\lambda$) value, which is a ratio of the determined AFR to a stoichiometric AFR (e.g., the AFR for a complete combustion reaction to occur) for a given mixture. Thus, a $\lambda$, value of 1.0 indicates a stoichiometric mixture, while a $\lambda$, value less than 1.0 indicates richer than stoichiometry mixtures and a $\lambda$, value greater than 1.0 indicates leaner than stoichiometry mixtures.

As described above, FIG. 1 shows only one cylinder of a multi-cylinder engine. As such each cylinder may similarly include its own set of intake/exhaust valves, fuel injector(s), spark plug(s), etc.

Fuel tanks in fuel system 8 may hold fuel with different fuel qualities, such as different fuel compositions. These differences may include different alcohol content, different octane, different heats of vaporization, different fuel blends, and/or combinations thereof, etc.

Controller 12 is shown in FIG. 1 as a microcomputer, including a microprocessor unit 106, input/output ports 108, an electronic storage medium for executable programs and calibration values shown as read-only memory chip 110 in this particular example, a random access memory 112, a keep alive memory 114, and a data bus. Controller 12 may receive various signals from sensors coupled to engine 10, including, in addition to those signals previously discussed, a measurement of inducted mass air flow (MAF) from a mass air flow sensor 122, a knock sensor 90 coupled to each cylinder 14 for identifying abnormal cylinder combustion events, engine coolant temperature (ECT) from a temperature sensor 116 coupled to a cooling sleeve 118, a profile ignition pickup signal (PIP) from a Hall effect sensor 120 (or other type) coupled to crankshaft 140, throttle position (TP) from a throttle position sensor, an absolute manifold pressure signal (MAP) from a MAP sensor 124, cylinder AFR from EGO sensor 128, abnormal combustion from knock sensor 90 and a crankshaft acceleration sensor, and VCR mechanism position from position sensor 196. Engine speed signal, RPM, may be generated by controller 12 from signal PIP. The signal MAP from MAP sensor 124 may be used to provide an indication of vacuum or pressure in the intake manifold. Controller 12 receives signals from the various sensors of FIG. 1 and employs the various actuators of FIG. 1 to adjust engine operation based on the received signals and instructions stored on a memory of the controller. For example, based on the engine speed and load, the controller may adjust the compression ratio of the engine by sending a signal to the VCR actuator 192, which actuates the VCR mechanism 194 to mechanically move the piston closer to or further from the cylinder head, thereby changing a volume of the combustion chamber.

Non-transitory storage medium read-only memory 110 can be programmed with computer readable data representing instructions executable by microprocessor unit 106 for performing the methods described below as well as other variants that are anticipated but not specifically listed.

In some examples, vehicle 5 may be a hybrid vehicle with multiple sources of torque available to one or more vehicle wheels 55. In other examples, vehicle 5 is a conventional vehicle with only an engine or an electric vehicle with only an electric machine(s). In the example shown, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example, during a braking operation.

As described above, a VCR mechanism may be used in conjunction with an electric actuator to vary a CR of an engine according to engine operating conditions. The VCR mechanism may comprise a number of components, as shown in an example of a VCR mechanism 200 coupled to a cranktrain 204 of a VCR engine in FIGS. 2 and 3. As one example, the VCR mechanism 200 may be the VCR mechanism 194 of FIG. 1. A side view 201 of the VCR mechanism 200 and cranktrain 204 is provided in FIG. 2 and a perspective view 301 of the VCR mechanism 200 and cranktrain 204 is illustrated in FIG. 3. A set of reference axes 202 are provided, indicating a y-axis, a z-axis, and an x-axis. In some examples, the y-axis may be parallel with a vertical direction, the z-axis with a transverse direction, and the x-axis with a horizontal direction. The VCR mechanism 200 includes an electric motor 206, which may be the VCR actuator 192 of FIG. 1, and an S-link 208 coupled at a first end 210 to the electric motor 206 and at a second end 212 to a control shaft 214.

The S-link 208 may have a substantially sinusoidal geometry, with a length 203 extending along the x-axis, as shown in FIG. 2, a height 205, defined as a distance between a top surface 211 and a bottom surface 213 of the S-link along the y-axis, and a thickness 207, shown in FIG. 3, measured along the z-axis. The top surface 211 and the bottom surface 213 of the S-link 208, with respect to the y-axis, may be curved while side surfaces 215 of the S-link 208, co-planar with a y-x plane, may be planar. The height 205 is smaller than the length 203 of the S-link 208, with the height 205 varying along the length 203. The thickness 207 is smaller than both the height 205 and the length 203, and may remain relatively uniform along the length 203 of the S-link 208. The S-link 208 may include apertures 209 extending entirely through the thickness 207 of the S-link 208. The apertures 209 may be circular through-holes, adapted to engage with a locking pin that holds a position of the S-link so that a desired CR is maintained. Each of the apertures 209 may result in a different positioning of pistons within combustion chambers of the engine, thus each of the apertures 209 may be associated with a different CR of the engine. In this way, the CR of the engine may be varied depending on which of the apertures 209 that the locking pin is engaged with. Details of the locking pin are described further below with reference to FIG. 6.

The control shaft 214 may be an elongate rod, extending along the z-axis as shown in FIG. 3 perpendicular to the length 203 of the S-link 208, which is rotatable in the directions indicated by an arrow 216. The control shaft 214 is connected to a crankshaft 218 of the cranktrain 204 by a plurality of arms 220. The plurality of arms 220 may be evenly spaced apart along a length 222, parallel with the z-axis, of the control shaft 214 which may also be a length of the crankshaft 218. Each arm of the plurality of arms 220 is secured at a first end 224 to the control shaft 214 so that the first end 224 of each arm rotates about the control shaft 214, within a range of angles. The first end 224 may be coupled to the control shaft 214 in such a manner that rotation of the control shaft 214 results in a change in an angle of the arm 220 relative to the y-axis. In one example, the first end 224 may couple around the control shaft with an opening that has an eccentric shape. A second end 226 of each arm of the plurality of arms 220 is attached to a first end 228 of a flange bearing 230 (also a crankpin journal or rod journal).

The flange bearing 230 may couple to the crankshaft 218 through a central portion of the flange bearing 230 and be configured to rotate within a range of angles in a similar direction as indicated by arrow 216. For example, the flange bearing 230 may be tilted between −30 and 30 degrees with respect to the x-axis. However, the range of angles through which the flange bearing 230 may rotate may vary depending on dimensions and orientation of surrounding and connected components. A second end 232 of the flange bearing 230 may be coupled to a connecting rod 234 of a piston 236. The connecting rod 234 extends downwards, along the y-axis, from a bottom 238 of the piston 236, and vertical movement (e.g., along the y-axis) of the connecting rod 234 drives/results from a vertical displacement of the piston 236 within a cylinder, such as cylinder 14 of FIG. 1. Movement of the connecting rod 234 may be induced by rotation of the flange bearing 230. Tilting of the flange bearing 230 may occur by activity of the VCR mechanism 200, initiated by the electric motor 206.

When activated, the electric motor 206 may adjust a position of the S-link 208 so that the S-link translates along directions indicated by arrow 240, shown in both FIGS. 2 and 3. The 5-link 208 remains engaged with the control shaft 214 as the S-link 208 moves, resulting in rotation of the control shaft 214. Rotation of the control shaft 214, as indicated by arrow 216, forces rotation of the first end 224 of each arm of the plurality of arms 220. As the first end 224 is partially unrotatably coupled to the control shaft 214, the rotation of the control shaft 214 results in translational motion of the first end 228 of the flange bearing 230. The first end 228 may move up or down, as indicated by arrow 242, as the control shaft 214 rotates, compelling reciprocal vertical motion at the second end 232 of the flange bearing 230. For example, in the side view 201 of FIG. 2, when the S-link 208 slides to the right, the control shaft 214 rotates in a counter-clockwise direction. The first end 224 of each arm of the plurality of arms 220 also rotates counter-clockwise, causing the first end 228 of the flange bearing 230 to move downwards. The second end 232 of the flange bearing 230 moves up as the first end 228 translate downwards, pushing the piston 236 up, along the y-axis, and decreasing a distance between a top 244 of the piston 236 and a cylinder head. Decreasing the distance between the top 244 of the piston 236 and the cylinder head increases the CR of the VCR engine.

Adjustment of the VCR mechanism 200 to increase the CR of the VCR engine is depicted in FIGS. 10A-10C. The VCR mechanism 200 is shown in a first position 1000 corresponding to a CR of 13:1, a second position 1020 corresponding to a CR of 10:1, and a third position 1040 corresponding to a CR of 8:1 in FIGS. 10A-10C, respectively. As an example, an increase in CR from the second position 1020 of FIG. 10B to the first position 1000 of FIG. 10A may be commanded when engine speed is reduced. The electric motor 206 may shift the S-link 208 to the right, towards the control shaft 214, as shown in FIG. 10A relative to FIG. 10B. As the S-link 208 shifts to the right, the control shaft 214 is rotated in a counterclockwise direction. The arms 200 are pulled down in FIG. 10A, with respect to the y-axis, due to the rotation of the control shaft 214, rocking the first end 228 of the flange bearing 230 downwards which, in turn, tilts the second end 232 of the flange bearing 230 up compared to the second position 1020 of FIG. 10B. The rocking of the flange bearing 230 in a counter-clockwise direction from the second position 1020 of FIG. 10B to the first position 1000 of FIG. 10A raises the position of the piston 236, indicated by dashed line 1002, relative to the second position 1020, indicated by dashed line 1003 in FIG. 10B.

Conversely, when the S-link 208 is moved to the left by the electric motor 206, the control shaft 214 rotates in a clockwise direction, driving the clockwise rotation of the first end 224 of each arm of the plurality of arms 220. The first end 228 of the flange bearing 230 moves upwards as the second end 232 moves down, pulling the piston 236 down and increasing the distance between the top 244 of the piston 236 and the cylinder head, thereby decreasing the CR of the VCR engine.

The adjustment of the VCR mechanism 200 to decrease the CR is further illustrated in FIGS. 10A-10C. A lowering of the position of the piston 236 may be depicted in the third position 1040 of FIG. 10C relative to both the second position 1020 of FIG. 10B and the first position 1000 of FIG. 10A, as well as the second position 1020 of FIG. 10B relative to the first position 1000 of FIG. 10A. As an example, a decrease in CR from the second position 1020 of FIG. 10B to the third position 1040 of FIG. 10C may be commanded when engine speed and charge increases. The electric motor 206 may shift the S-link 208 to the left, away from the control shaft 214, as shown in FIG. 10C relative to FIG. 10B. As the S-link 208 shifts to the left, the control shaft 214 is rotated in a clockwise direction. The arms 200 are pushed up in FIG. 10C, with respect to the y-axis, due to the rotation of the control shaft 214, rocking the first end 228 of the flange bearing 230 upwards which, in turn, tilts the second end 232 of the flange bearing 230 down compared to the second position 1020 of FIG. 10B. The rocking of the flange bearing 230 in a clockwise direction from the second position 1020 of FIG. 10B to the third position 1040 of FIG. 10A lowers the position of the piston 236, indicated by dashed line 1004, relative to the second position 1020, indicated by dashed line 1003.

The VCR mechanism 200 and cranktrain 204 of a VCR engine are depicted in FIG. 3 with four each of arms, flange bearings, connecting rods, and pistons. It will be appreciated, however, that while four of each type of component is shown in FIG. 3 for adaptation to a four-cylinder inline (14) engine, the cranktrain 204 and VCR mechanism 200 of FIG. 3 are non-limiting examples and other quantities and orientations of the various components are possible without departing from the scope of the present disclosure.

A cranktrain and a VCR mechanism may be housed within a crankcase of a VCR engine. An example of a VCR engine 400 is shown in FIG. 4, illustrating exterior surfaces of a crankcase 401 as well as an upper oil pan 402 and a lower oil pan 404. A cranktrain, such as the cranktrain 204 of FIGS. 2 and 3, may be enclosed within the crankcase 401 with an end of a crankshaft 406 protruding from a side wall 408 of the crankcase 401. An end of a control shaft 410 may also protrude from the side wall 408 of the crankcase 401, with a predominant portion of the control shaft 410 positioned within the crankcase 401 and connected to the crankshaft 406 by a plurality of arms, such as the plurality of arms 220 shown in FIG. 3.

The upper oil pan 402 may be coupled to a front side 412 of the crankcase 401. The upper oil pan 402 and the lower oil pan 404 may be positioned at a bottom 414 of the crankcase 401. The lower oil pan 404 may be an oil sump and may, in some examples, house an oil pump. The upper oil pan 402 may be fluidly coupled to the lower oil pan 404 and together the upper oil pan 402 and lower oil pan 404 may provide a reservoir of oil for lubricating engine components and collecting residual oil.

At least a portion of the VCR mechanism 502, which may be the VCR mechanism 200 of FIGS. 2 and 3, may be enclosed within the crankcase 401, as shown in FIG. 5. An electric motor 418, coupled to the VCR mechanism and adapted to engage mechanically with the VCR mechanism 502, may be arranged along an outer surface of the upper oil pan 402, above the lower oil pan 404 and secured to the outer surface of the upper oil pan 402, external to the crankcase 401. A bottom view 500 of the bottom 414 of the crankcase 401 is shown in FIG. 5, taken along line A-A' indicated in FIG. 4. The lower oil pan 404 is removed in the bottom view 500 to show a positioning of the VCR mechanism 502 within the crankcase 401.

A positioning of the control shaft 410 under a first end 420 of an S-link 422 is indicated in FIG. 5 but not shown. The control shaft 410 may be coupled to the first end 420 of the S-link 422, which may be the S-link 208 of FIGS. 2 and 3. The S-link 422 may extend along the x-axis, through the front side 412 of the crankcase 401 to couple at a second end, the second end opposite of the first end 420, to the electric motor 418 outside of the crankcase 401. The S-link 422 may include apertures 424, extending through a thickness, defined along the z-axis, of the S-link 422, similar to the apertures 209 of FIGS. 2 and 3. A diameter and shape of the apertures 424 may be adapted to accept insertion of a locking pin 426 when the S-link 422 is adjusted to a position where one of the apertures 424 is in alignment with the locking pin 426. The locking pin 426 may have a curved outer surface to match the shape of the apertures 424 and may slide back and forth along the z-axis, as indicated by arrow 428. The movement of the locking pin 426 either engages or disengages the locking pin 426 from one of the apertures 424. When inserted into one of the apertures 424, the locking pin 426 may hold the position of the S-link 422 relative to the control shaft 410, thus stopping rotation of the control shaft and sustaining the CR of the VCR engine 400. When the locking pin 426 is disengaged from the apertures 424, the S-link 422 is free to move as guided by the electric motor 418.

While motion of the S-link of the VCR mechanism may be controlled by the electric motor, sliding of the locking pin may be enabled by hydraulic pressure. An oil-based hydraulic pressure system used to actuate movement of a locking pin in a VCR mechanism, e.g., the VCR mechanism 200 of FIGS. 2 and 3 and 502 of FIG. 5, is shown in a first schematic diagram 600 in FIG. 6 and a second schematic diagram 700 in FIG. 7. A VCR mechanism 602 is depicted in the first and second schematic diagrams 600, 700 in a first and second position, respectively, from a cross-sectional view of a VCR engine that, for example, may be taken along line A-A' of FIG. 4 and co-planar with the y-z plane.

The VCR mechanism 602 includes an S-link 604, a locking pin 606, a spring 608 in contact with a first end 610 of the locking pin 606, a first oil pan boss 612, a second oil pan boss 614, an oil chamber 616, and a two-position valve (TPV) 618. The TPV 618 may be arranged at a location in the VCR engine proximate to the VCR mechanism 602. For example, the TPV 618 may be mounted to a surface of an upper oil pan, such as the upper oil pan 402 of FIG. 4.

The TPV 618 may be configured as a solenoid valve that is actuated based on electromagnetic force. The TPV 618 may include an electromagnetic device 611 that generates a magnetic field to repulse a set of pilot pistons 632 of the TPV 618 to slide toward the electromagnetic device 611 into a second position shown in FIG. 7 when the electromagnetic device 611 is energized, e.g., the electromagnetic device is electrically activated. When the electromagnetic device 611 is de-energized, the TPV 618 may be adapted to automatically slide into a relaxed, first position, shown in FIG. 6.

Furthermore, the TPV 618 may be fluidly coupled to a high pressure oil source 605 by an inlet 640 and to a low pressure oil source 607 by an oil vent 646. In one example, the inlet 640 of the TPV 618 may be connected to an engine oil gallery or other oil passage downstream of an oil pump that delivers oil under pressure. The oil vent 646 may be coupled to an oil source at ambient pressure, such as the oil sump. In another example, the oil vent may be oriented so that oil flowing out of the TPV 618 through the oil vent 646 may be gravity fed and collect in the oil sump.

The high pressure oil source 605, as described above, may be coupled to an engine oil pump, engine oil gallery, or another device that delivers oil at a higher pressure than ambient pressure. A valve (not shown) may be arranged in the inlet 640 to block flow of oil through the inlet 640 when a threshold pressure in the VCR mechanism 602 is attained by flowing oil from the high pressure oil source 605 in the VCR mechanism 602. The low pressure oil source 607 may be at ambient pressure, or may be exposed to a vacuum source, such as vacuum pump, a brake booster, or coupled to an intake manifold by a vacuum line to maintain vacuum with the low pressure oil source 607. A difference in pressures between the high pressure oil source 605 and the lower pressure oil source 607 may result in movement of the locking pin 606 within the VCR mechanism 602, as described further below.

Figure 6:
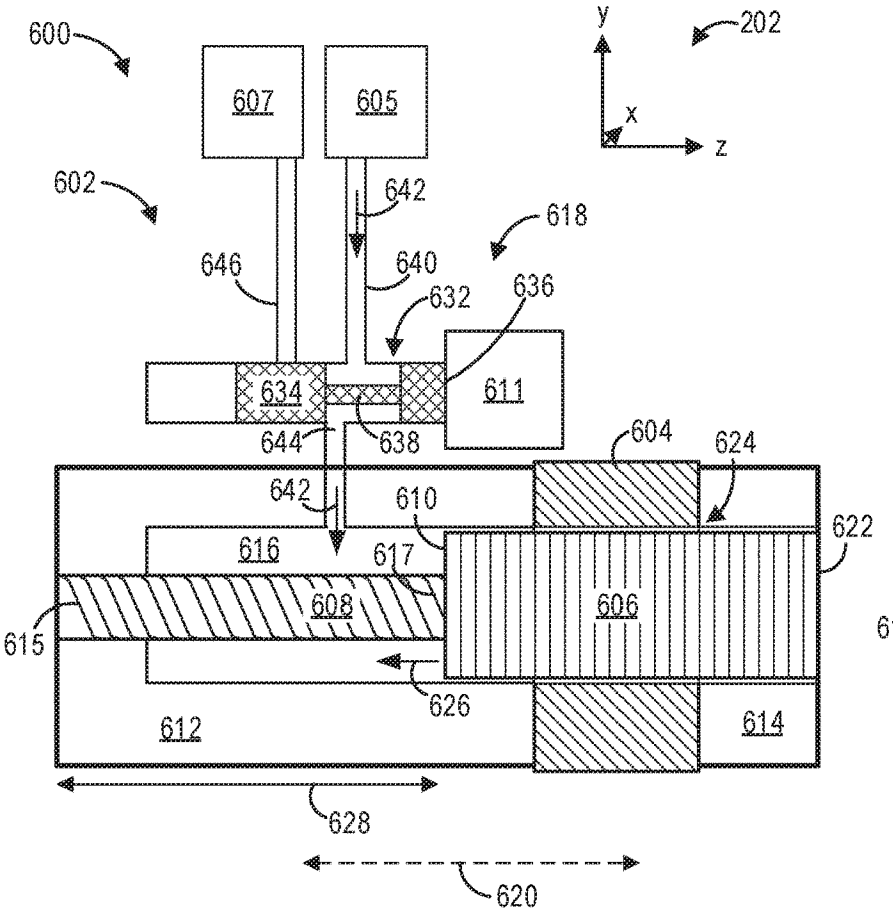
FIG. 6 shows a first schematic diagram of the VCR mechanism in a first position along with a two-position valve and a locking pin coupled to a spring.

The locking pin 606 may be adapted to slide along the z-axis, according to arrow 620, so that when the locking pin 606 is positioned in the first position, as shown in FIG. 6, a second end 622 of the locking pin 606 is inserted through an aperture 624 of the S-link 604 and into the second oil pan boss 614. The second oil pan boss 614, as well as the first oil pan boss 612, may be integrated into a wall of the high pressure oil source 605 to secure an arrangement of the locking pin 606 and spring 608 within the VCR mechanism 602. Thus the first and second oil pan bosses 612, 614 may be rigidly fixed to an unmovable structure and provide retaining structures for maintaining the locking pin 606 in place relative to motion of the locking pin 606 along the y-x plane. By inserting the second end 622 of the locking pin 606 into the second oil pan boss 614 with the first end 610 of the locking pin 606 still positioned in the first oil pan boss 612, the locking pin 606 may resist forces exerted on the locking pin 606 by the S-link 604 along the y-x plane based on contact between the second end 622 of the locking pin 606 and the second oil pan boss 614 and contact between the first end 610 of the locking pin 606 and the first oil pan boss 612. The locking pin 606 is thus secured in place mechanically and with little energy expenditure.

In the first position of the locking pin 606, e.g., translated to the right as illustrated in FIG. 6, the spring 608 may be extended, exerting a force on the first end 610 of the locking pin 606 towards the left, as indicated by arrow 626. A first end 615 of the spring 608 may be integrated into a material of the first oil pan boss 612, e.g., welded in place, or inserted into an aperture in the second oil pan boss adapted to accept the first end 615 of the spring 608. A second end 617 of the spring is in contact with the first end 610 of the locking pin 606 and maintains the contact whether in the first position of FIG. 6 or the second position of FIG. 7.

Figure 7:
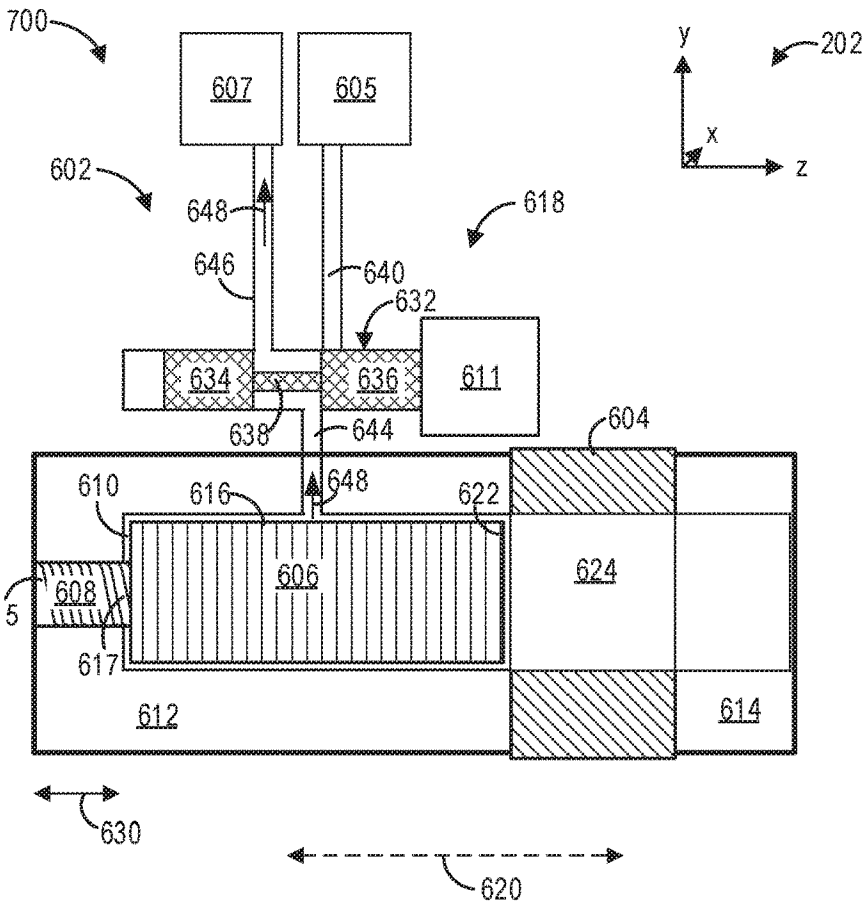
FIG. 7 shows a second schematic diagram of the VCR mechanism in a second position along with the two-position valve and the locking pin coupled to the spring.
Figure 8:
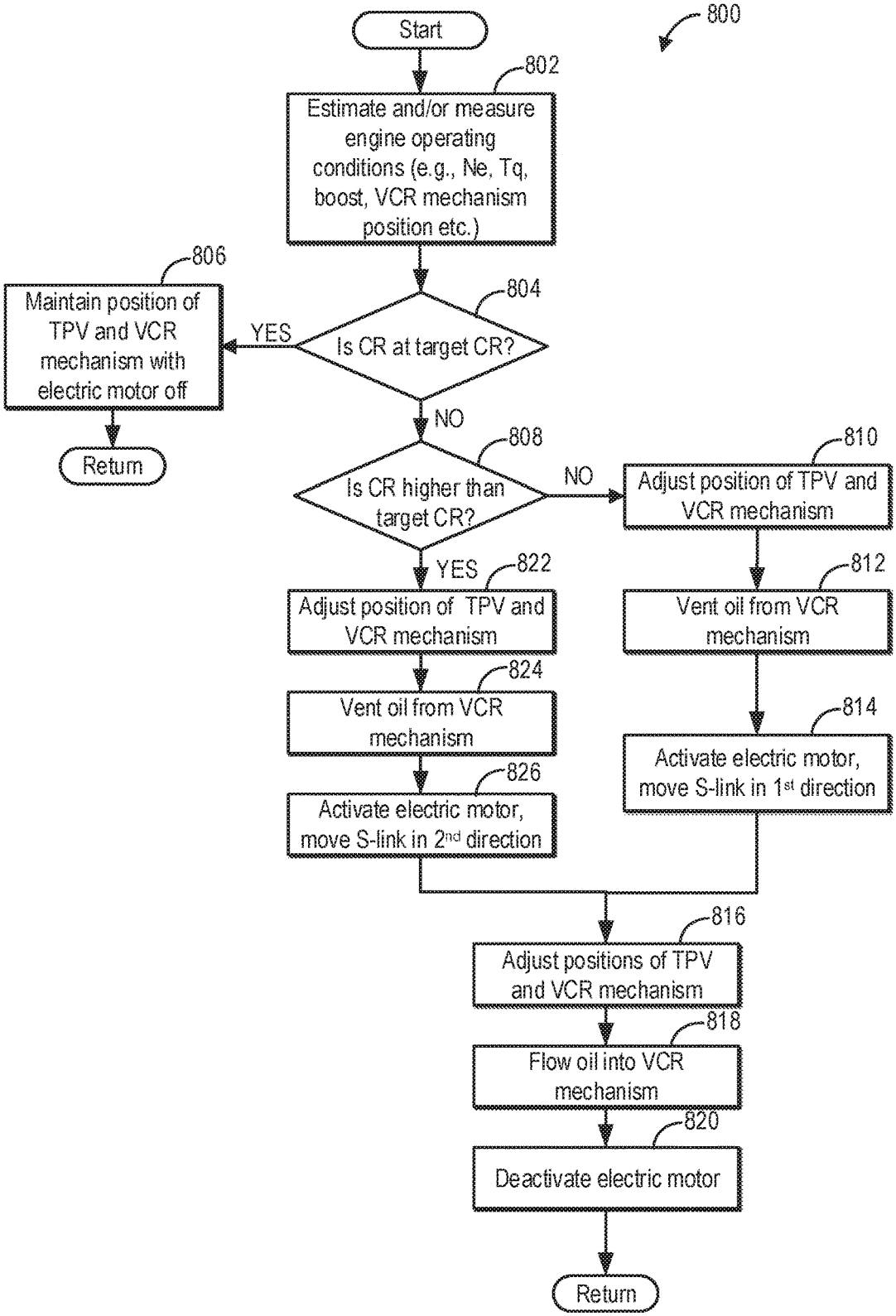
FIG. 8 shows an example of a method for operating the VCR mechanism according to engine operating conditions.

The locking pin 606 may be adjusted to a second position, as shown in FIG. 7 where the locking pin 606 is shifted to the left so that the second end 622 of the locking pin 606 is no longer inserted in the second oil pan boss 614. Instead, the locking pin 606 may be entirely situated within the first oil pan boss 612 and the spring 608 may be fully contracted, e.g., an extended length 628 of the spring 608 when the locking pin 606 is in the first position of FIG. 6 is longer, defined along the z-axis, than a contracted length 630 of the spring 608 when the locking pin 606 is in the second position of FIG. 7. In the second position, the locking pin 606 is not in contact with the S-link 604 and the S-link is free to slide along the y-x plane.

A placement of a locking pin in a cranktrain of a VCR engine is shown in FIG. 11A. A cranktrain 1100 of FIG. 11A includes a crankshaft 1102 coupled to a single piston 1104 for simplicity. A VCR mechanism 1106, which may be the VCR mechanism 602 of FIGS. 6-7 and 200 of FIGS. 2-3, is coupled to the crankshaft 1102 by an arm 1108 extending between the crankshaft 1102 and a control shaft 1110 of the VCR mechanism 1106.

Figure 11B:
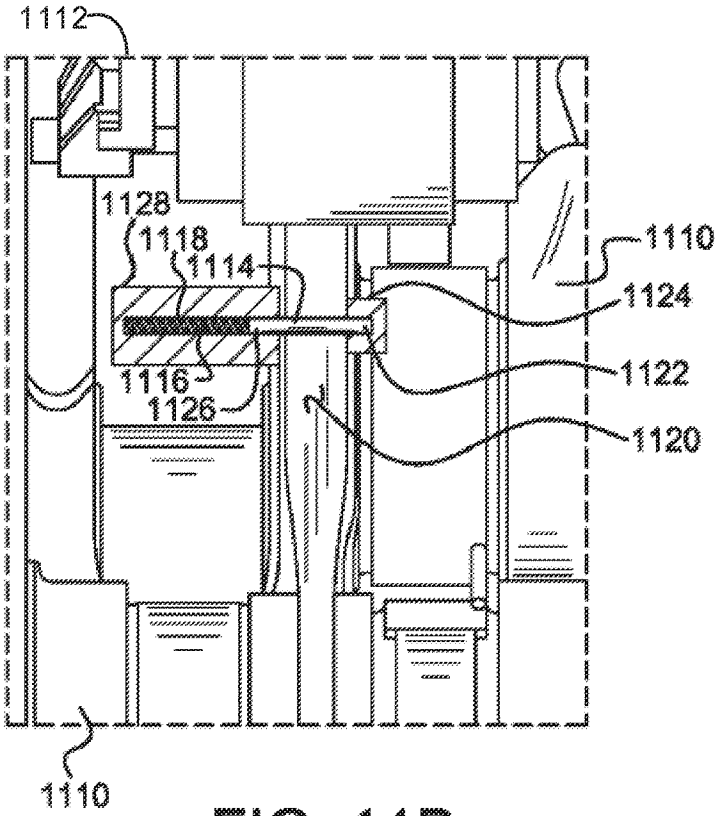
FIG. 11B is an expanded insert showing a detailed view of a section of the VCR engine shown in FIG. 11A to illustrate an arrangement of a locking pin of the VCR mechanism.
Figure 11A:
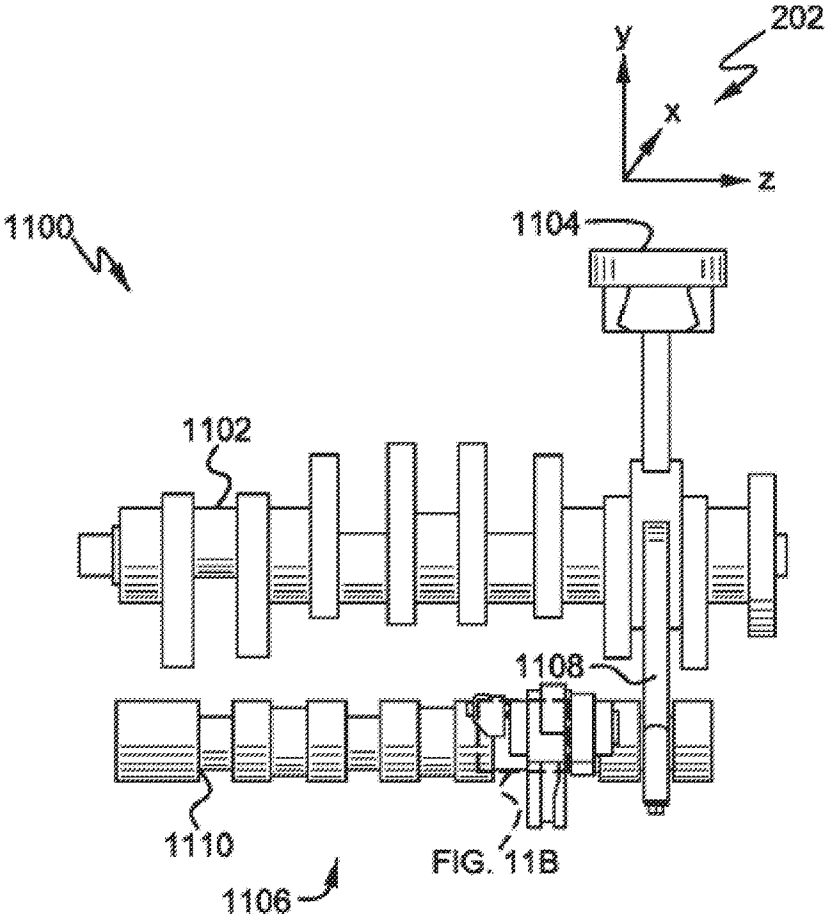
FIG. 11A shows a positioning of the VCR mechanism relative to a cranktrain of the VCR engine.

A portion of the VCR mechanism 1106 is depicted in FIG. 11B in an expanded insert 1112, showing a locking pin 1114, which may be the locking pin 606 of FIGS. 6-7, and a spring 1116 contained within an oil chamber 1118 of the VCR mechanism 1106. The locking pin 1114 is oriented in the first position of FIG. 6, inserted through an aperture of an S-link 1120 that engages with the control shaft 1110. A first end 1122 of the locking pin 1114 is placed in a first oil pan boss 1124 while a second end 1126 of the locking pin 1114 and the spring 1116 are enclosed by a second oil pan boss 1128. The first and second oil pan bosses 1122, 1128 may be integrated into a surface of an oil reservoir (not shown) positioned in close proximity to the control shaft 1110.

Returning to FIGS. 6-7, a combination of the TPV 618 and the force exerted by the spring 608 may regulate adjustment of the locking pin 606 between the first and second positions. The TPV 618 may be configured to also translate between the first position, e.g., where the set of pilot pistons 632 are shifted to the right as shown in FIG. 6, and the second position, as shown in FIG. 7 where the set of pilot pistons 632 are shifted to the left based on energization of the electromagnetic device 611. The set of pilot pistons 632 includes a first piston 634 connected to a second piston 636 by a stem 638. The set of pilot pistons 632 may move as a single unit along the z-axis between the first and second positions, alternating between allowing oil to flow in a forward direction from the high pressure oil source 605 to the oil chamber 616 of the VCR mechanism 602 in the first position and blocking forward flow of oil from the high pressure oil source 605 to the oil chamber 616 while in the second position. In the second position shown in FIG. 7, the oil may instead flow in a reverse direction, from the oil chamber 616 to the low pressure oil source 607.

For example, in the first position of TPV 618 and of the VCR mechanism 602 in FIG. 6, the TPV 618 may be coupled to the high pressure oil source 605 by an inlet 640. Adjustment of the TPV 618 to the first position may be commanded by an engine controller, such as the controller 12 of FIG. 1, and comprises deactivating the electromagnetic device 611 and positioning the TPV 618 so that the first piston 634 of the set of pilot pistons 632 is aligned with an oil vent 646, blocking flow of oil between the oil chamber 616 and the low pressure oil source 607 through the oil vent 646, while the second piston 636 of the set of pilot pistons 632 is to the right of the inlet 640 and not blocking the inlet 640.

Pressure in the high pressure oil source 605 may be higher than a pressure of the oil chamber 616. The pressure gradient may drive oil flow in the forward direction, as indicated by arrows 642, from the high pressure oil source 605, through the inlet 640, past the stem 638 of the set of pilot pistons 632, through an oil channel 644 and into the oil chamber 616. If the TPV 618 is adapted with a valve in the inlet 640, the valve may be open. The introduction of oil into the oil chamber 616 increases a pressure of the oil chamber 616, overcoming an elastic force of the spring 608 and pushing the locking pin 606 to the right into the first position. Upon detection of a pressure of the oil chamber 616 reaching a pressure threshold, such as an estimated pressure of the oil chamber 616 when the oil chamber 616 is filled with oil, the valve in the inlet 640 may be closed. When driven into the first position, the locking pin 606 is inserted into the aperture 624 of the S-link 604, locking the S-link 604 in place and holding pistons of the VCR engine at a target compression ratio specific to the aperture 624. In this position, an electric motor, e.g., the electric motor 206 of FIGS. 2 and 3 and 418 of FIGS. 4 and 5, may be deactivated, thereby reducing energy consumed by operation of the electric motor.

When the TPV 618 is commanded to shift to the second position shown in FIG. 7, the electromagnetic device 611 is energized, pushing the TPV 618 into the second position with the second piston 636 of the set of pilot pistons 632 aligned with the inlet 640. Oil flow from the high pressure oil source 605 into the oil source 626 in the forward direction is blocked. The first piston 634 of the set of pilot pistons 632 is not aligned with the oil vent 646 but is instead positioned offset (e.g., to the left) of the oil vent 646. The oil chamber 616 and the low pressure oil source 607 may be fluidly coupled by the oil vent 646 when the TPV 618 is in the second position.

At least a portion of the oil in the oil chamber 616 may vent into the low pressure oil source 607, flowing in the reverse direction, as indicated by arrows 648. Oil travels from the oil chamber 616, through the oil channel 644, past the stem 638 of the set of pilot pistons 632 and into the low pressure oil source 607 through the oil vent 646. An amount of oil that vents into the low pressure oil source 607 may depend on a pressure gradient between the oil chamber 616 and the low pressure oil source 607.

When the TPV 618 is adjusted into the second position of FIG. 7 from the first position of FIG. 6, a release in pressure in the oil chamber 616 may allow the elastic force of the spring 608 to pull the locking pin 606 to the left as the spring 608 contracts and relaxes. The sliding of the locking pin 606 to the left compels oil to drain into the low pressure oil source 607 as the volume in the oil chamber 616 is increasingly occupied by the locking pin 606.

The locking pin 606 may be disengaged from the S-link 604 in the second position, freeing a motion of the S-link 604. The electric motor may be activated to adjust a positioning of the S-link 604 so that the locking pin 606 may be aligned with a different aperture corresponding to a desired compression ratio of the VCR engine. When aligned with the target aperture of the S-link 604, the TPV 618 may be commanded to the first position to engage with locking pin 606 with the newly aligned aperture and the electric motor may be deactivated with the S-link 604 held in place by the locking pin 606. The VCR mechanism 602 may thus modify the compression ratio of the engine by electric actuation to move the S-link 604 and a combination of hydraulic pressure and elastic force of the spring 608 to move the locking pin 606. Thus a fuel efficiency of the VCR engine is increased by locking the VCR engine to a CR via engagement of the locking pin 606 with the S-link 604 and allowing deactivation of the electric motor once the target compression ratio is attained.

An example of a method 800 for varying a compression ratio (CR) of a VCR engine is depicted. The VCR engine may be the engine 10 of FIG. 1 or 400 of FIG. 4, adapted with a VCR mechanism such as the VCR mechanism 200 of FIGS. 2 and 3, 502 of FIG. 5, and 602 of FIGS. 6 and 7. The VCR mechanism may be positioned within a crankcase of the VCR engine and connected to a two-position valve (TPV) that fluidly couples an oil chamber of the VCR mechanism to a high pressure oil source and a low pressure oil source. The TPV may be an electromagnetically controlled solenoid valve and motion of the TPV valve may occur in response to a magnetic field. A control shaft connected to a crankshaft that is linked to pistons of the engine, a locking pin, a spring, and an S-link may be included in the VCR mechanism, arranged as shown in FIGS. 2-7. The S-link may extend through an outer wall of the crankcase to attach at one end to an electric motor that controls movement of the S-link when activated. Method 800 may begin with the TPV and VCR mechanism in a first position, similar to the first position shown in FIG. 6, with the high pressure oil source fluidly coupled to the oil chamber of the VCR mechanism via an oil inlet, with oil stored in an oil chamber of the VCR mechanism and the locking pin inserted into an aperture of the S-link. Instructions for carrying out routine 800 and the rest of the methods included herein may be executed by a controller, such as controller 12 of FIG. 1, based on instructions stored on a memory of the controller and in conjunction with signals received from sensors of the engine system, such as the sensors described above with reference to FIG. 1. The controller may employ engine actuators of the engine system to adjust engine operation, according to the methods described below.

At 802, the method includes estimating and/or measuring operating conditions of the VCR engine. For example, engine speed may be determined from a Hall effect sensor, such as the hall effect sensor 120 of FIG. 1, torque request may be determined based on a pedal position sensor of an accelerator pedal, such as the pedal position sensor 134 of the input device 132 of FIG. 1, boost supplied by a turbocharger may be determined based on a MAF sensor, such as the MAF sensor 122 of FIG. 1, a position of the VCR mechanism may be detected by a position sensor such as the VCR mechanism position sensor 196 shown in FIG. 1, and an inferred compression ratio (CR) of the engine may be determined based on the position of the VCR mechanism.

The method includes determining whether the CR is at a target CR at 804. The target CR may be a ratio between 8:1 and 14:1 calculated based on the engine speed and the boost provided by the turbocharger in response to the torque demand. For example, when the engine speed increases and additional air is delivered to the engine intake by the turbocharger, the target CR may be decreased, corresponding to an increase in distance between piston tops and a cylinder head of the engine, to reduce a likelihood of engine knock occurring. Conversely, if engine speed decreases and boost pressure is reduced relative to when engine speed and torque demand are high, the target CR may be increased, corresponding to a decrease in distance between the piston tops and the cylinder head.

The controller may evaluate the current CR of the engine by referring to a position sensor of the VCR mechanism, such as the position sensor 196 of FIG. 1, to determine which aperture of the S-link is engaged by the locking pin of the VCR mechanism. Each aperture of the S-link may correspond to a specific CR and the CR for each aperture may be provided in a look-up table stored in the memory of the controller. If the CR of the engine is at the inferred target CR, the method proceeds to 806 to maintain a current position of the TPV and VCR mechanism, e.g., with the TPV and VCR mechanism in the first position, continuing engine operation at the current CR. Method 800 may return to the start of the method.

If the CR of the engine is not at the target CR, the method continues to 808 to determine whether the CR is higher than the target CR. If the current CR is not higher than target CR, the CR is lower than the target CR. The method then proceeds to 810 where the TPV and VCR mechanism are adjusted to the second position, e.g., the second position shown in FIG. 7, thereby fluidly coupling the oil reservoir of the VCR mechanism to the low pressure oil source via an oil vent of the VCR mechanism. An electromagnetic device controlling movement of the TPV valve is energized, pushing the TPV into the second position. Oil flows in a reverse direction from the VCR mechanism to the low pressure oil source at 812 due to a lower pressure in the low pressure oil source relative to the oil chamber of the VCR mechanism. A decrease in pressure in the oil chamber allows the spring to pull the locking pin into the second position of the VCR mechanism, removing the locking pin from the aperture of the S-link. As the spring pulls the locking pin in the second position, the movement of the locking pin pushes a remaining amount of oil in the oil chamber of the VCR mechanism out, through the oil vent and into the low pressure oil reservoir.

At 814, the method includes activating the electric motor and compelling the S-link to move in a first direction that rotates the control shaft in a first direction. The rotation of the control shaft in the first direction results in a position of the pistons within engine cylinders to be raised so that a volume of a space between the piston tops and a cylinder head is decreased, thereby increasing the CR. The controller may command movement of the S-link to align a target aperture of the S-link with the locking pin. The controller may refer to, for example, the look-up table stored in the memory of the controller providing the CR assigned to each aperture of the S-link. The controller may receive information from the VCR mechanism position sensor to determine when the desired aperture is aligned with the locking pin. Additionally or alternatively, the controller may determine a degree of rotation of the control shaft that is needed to move the control shaft from the current position to a position that will provide the target CR, and the controller may command the electric motor to rotate the control shaft by the determined degree of rotation.

The method proceeds to 816 to command adjustment of the TPV into the first position by deactivating the electromagnetic device. In the first position, e.g., the first position shown in FIG. 6, the TPV is shifted so that the oil vent of the VCR mechanism is blocked and the oil chamber of the VCR mechanism is fluidly coupled to the high pressure oil source via the oil inlet of the VCR mechanism. At 818, oil flows in the forward direction from the high pressure oil source into the oil chamber due to the higher pressure in the high pressure oil source compared to the oil chamber, increasing the pressure in the oil chamber and pushing the locking pin against the elastic force of the spring so that the locking pin is inserted into the aperture. Upon engagement of the locking pin with the aperture, the electric motor is deactivated at 820. Following deactivation of the electric motor, the method 800 returns to the start of the method.

Returning to 808, if the CR of the VCR engine is determined to be above the target CR the method includes adjusting the position of the TPV to the second position at 822 to decrease the CR. Oil flows in the reverse direction from the VCR mechanism to the low pressure oil source at 826 through the oil vent of the VCR mechanism due to a lower pressure in the low pressure oil source relative to the oil chamber. A decrease in pressure in the oil chamber allows the spring to pull the locking pin into the second position of the VCR mechanism, removing the locking pin from the aperture of the S-link.

At 826, the method includes activating the electric motor and compelling the S-link to move in a second direction, opposite of the first direction, which rotates the control shaft in a second direction, also opposite of the first direction. The rotation of the control shaft in the second direction results in a position of the pistons within engine cylinders to be lowered so that a volume of a space between the piston tops and a cylinder head is increased, thereby decreasing the CR. The controller may command movement of the S-link to align a target aperture of the S-link with the locking pin. The controller may refer to, for example, the look-up table stored in the memory of the controller providing a CR assigned to a specific aperture of the S-link. The controller may receive information from the VCR mechanism position sensor to determine when the desired aperture is aligned with the locking pin. Additionally or alternatively, the controller may determine the degree of rotation of the control shaft that is needed to move the control shaft from the current position to a position that will provide the target CR, and the controller may command the electric motor to rotate the control shaft by the determined degree of rotation.

The method proceeds to 816 to command adjustment of the TPV into the first position when the desired S-link aperture is aligned with the locking pin. In the first position, e.g., the first position shown in FIG. 6, the TPV is shifted so that the oil vent of the VCR mechanism is blocked and the oil chamber of the VCR mechanism is fluidly coupled to the high pressure oil source via the oil inlet of the VCR mechanism. At 818, oil flows in the forward direction from the high pressure oil source into the oil chamber due to the higher pressure in the upper oil pan compared to the oil chamber, increasing the pressure in the oil chamber and pushing the locking pin against the elastic force of the spring so that the locking pin is inserted into the aperture. Upon engagement of the locking pin with the aperture, the electric motor is deactivated at 820. Following deactivation of the electric motor, the method 800 returns to the start of the method.

Figure 9:
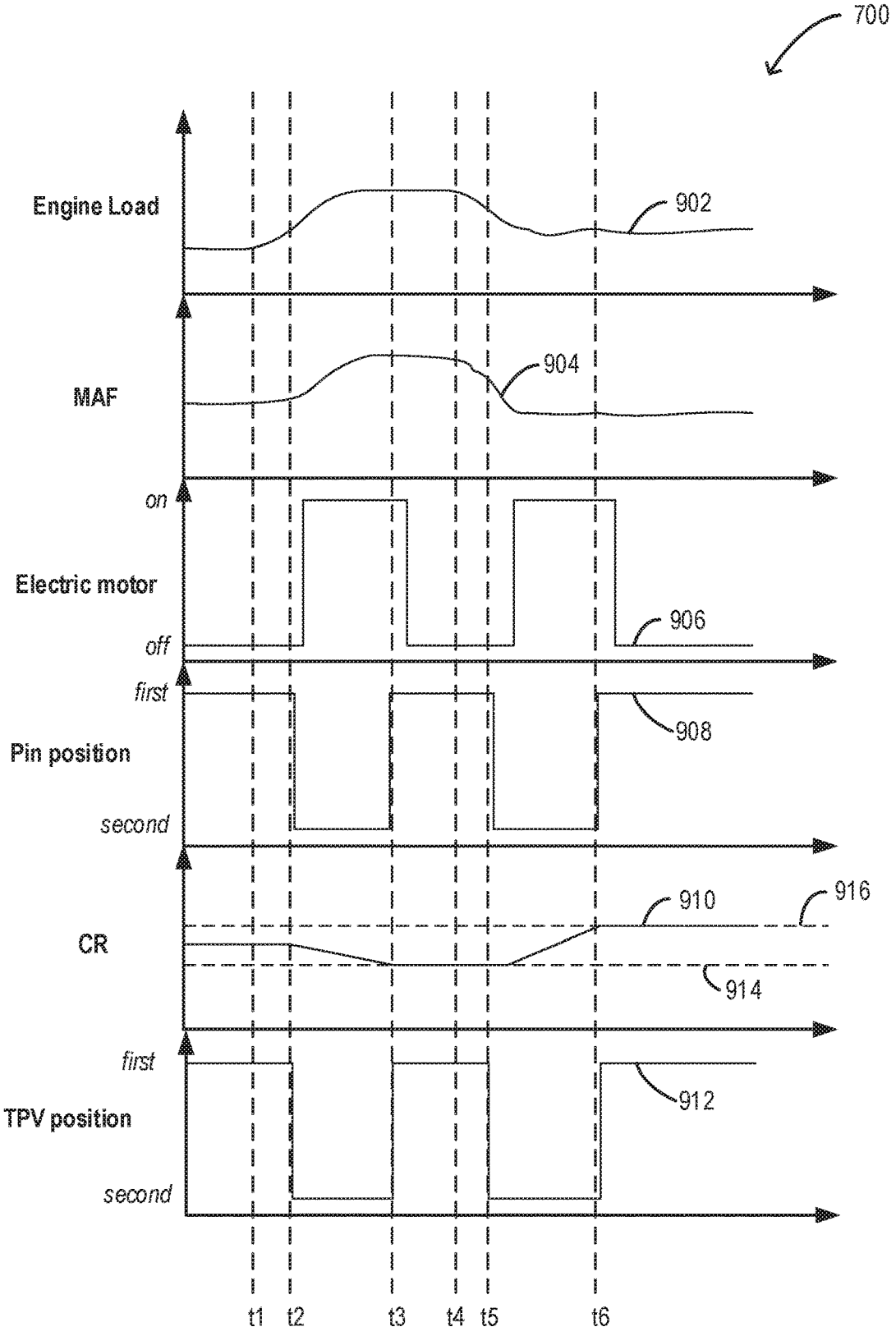
FIG. 9 shows example operations of the VCR engine during events where the compression ratio of the engine is adjusted according to engine operating conditions.
Figure 10B:
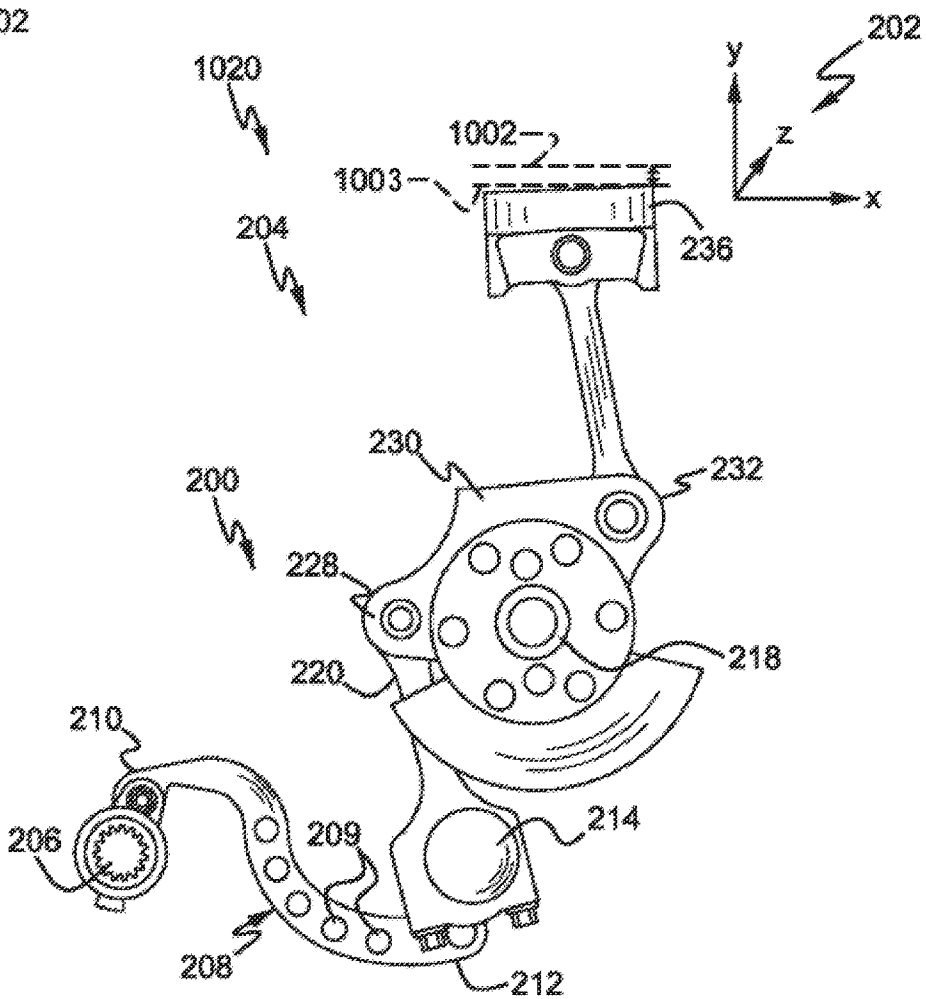
FIG. 10B shows the VCR mechanism in a second position corresponding to a CR between the CR of FIG. 10A and a CR of FIG. 10C.
Figure 10A:
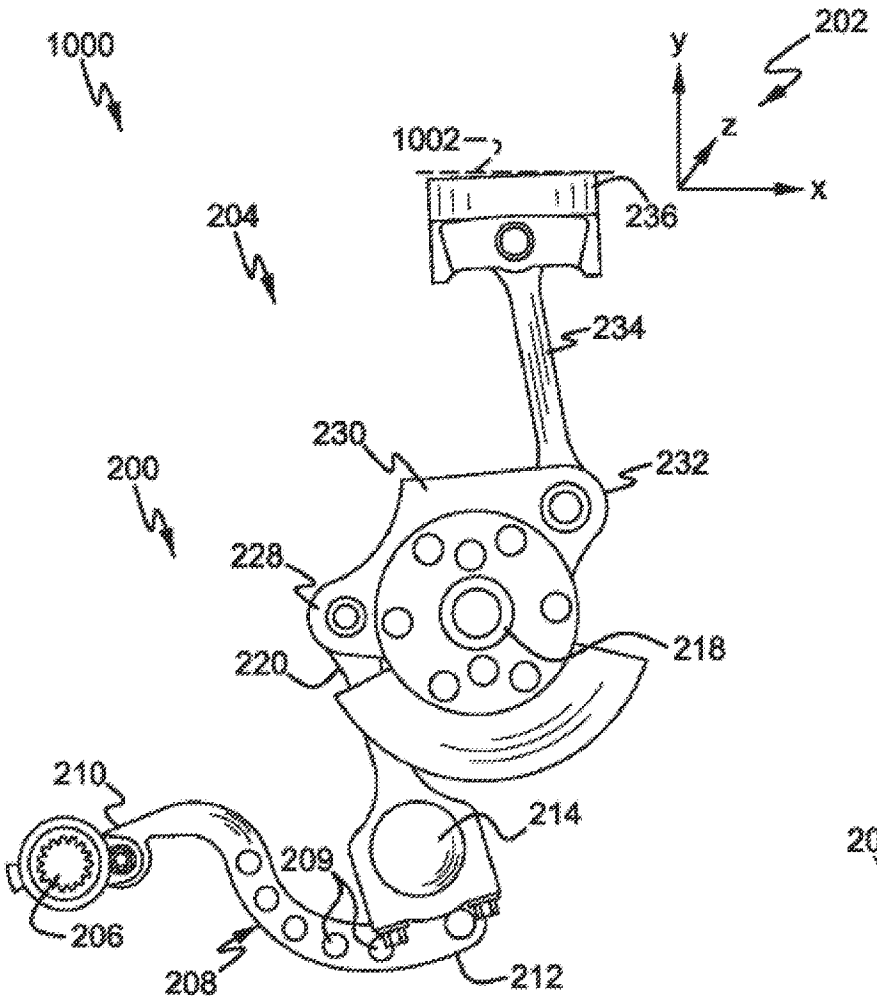
FIG. 10A shows the VCR mechanism in a first position corresponding to an increased CR than the CR of FIG. 10B.
Figure 10C:
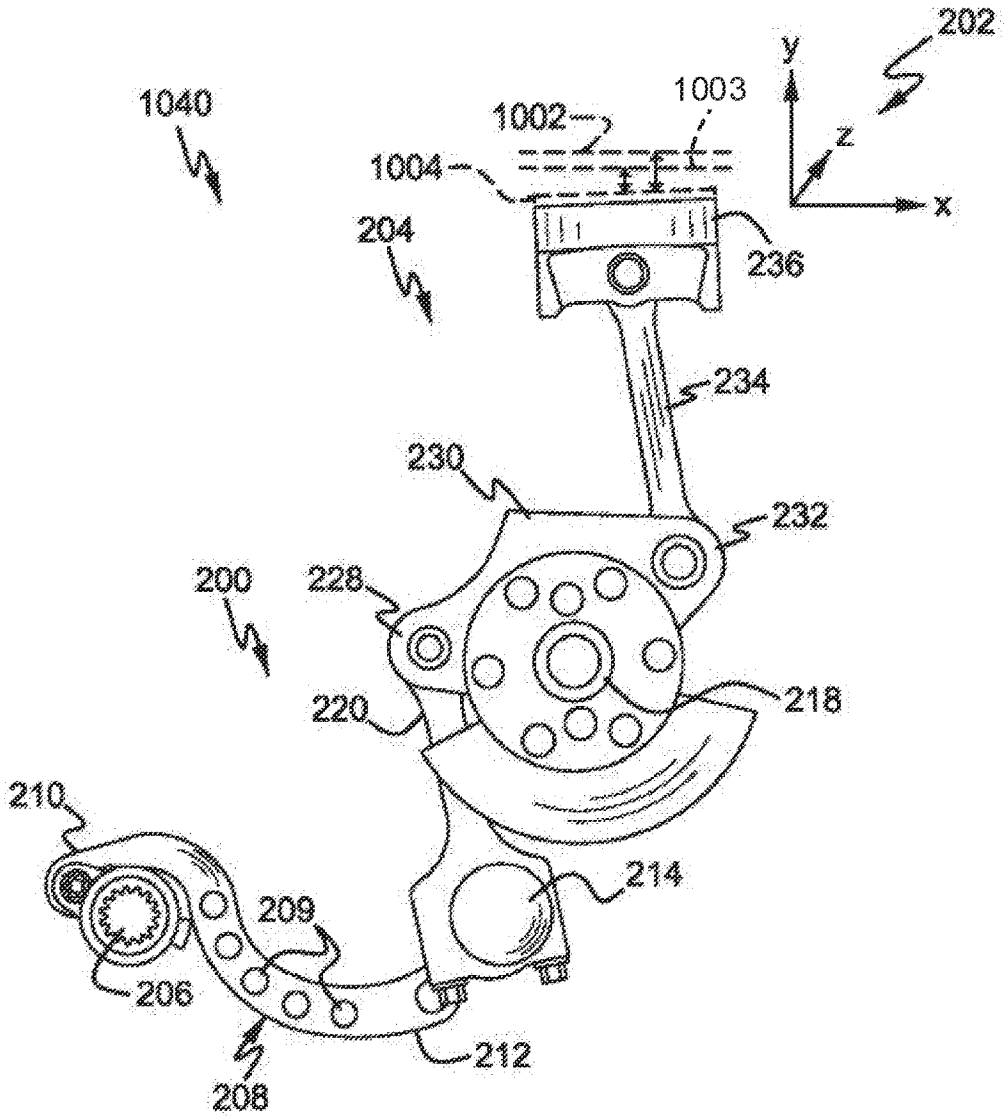
FIG. 10C shows the VCR mechanism in a third position corresponding to a CR lower than the CR of FIG. 10B.

Example operations of a VCR engine in a vehicle are shown in FIG. 9 in a map 900. The vehicle may be the vehicle 5 of FIG. 1, adapted with a VCR mechanism coupled to an electric motor and to flange bearings of a crankshaft of the VCR engine, as shown in FIG. 3. Adjustment of the VCR mechanism between a first position where a CR of the engine is maintained and a second position where the CR may be modified is actuated by a two-position valve (TPV). Map 900 depicts relationships between engine load (plot 902), mass air flow (MAF, plot 904) into the engine intake, activation and deactivation of an electric motor (plot 906) controlling movements of an S-link of a VCR mechanism, a position of a locking pin (plot 908) of the VCR mechanism between the first position and the second position, a compression ratio (plot 910) of the VCR engine according to a height of pistons within combustion chambers of the engine, and a position of the two-position valve (TPV), alternating between a first position and a second position, such as the first and second positions shown in FIGS. 6 and 7, respectively. Time is plotted along an x-axis of map 900.

Initially, the locking pin (plot 908) and the TPV (plot 912) may both be in respective first positions with both the electric motor and an electromagnetic device controlling motion of the TPV turned off. At t1, the engine load (plot 902) increases due to, for example, uphill navigation of the vehicle or an increased demand for torque. The increase in engine load results in an increase in MAF (plot 904) due to delivery of boosted air from a turbocharger. In order to provide sufficient power and decrease a likelihood of engine knock, an engine controller, such as the controller 12 of FIG. 1, may command actions to decrease the CR.

At t2, the TPV is adjusted to the second position by energizing the electromagnetic device, causing oil to flow in a reverse direction, from an oil chamber of the VCR mechanism to a low pressure oil source of the VCR engine. A decrease in oil pressure in the oil reservoir allows a spring coupled to the locking pin to pull the locking pin into the second position pushing remaining oil out of the oil chamber as the locking pin disengages from the S-link of the VCR mechanism. The electric motor is activated, adjusting a position of the S-link so that the locking pin is aligned with an aperture of the S-link corresponding to a desired, lower CR.

Between t2 and t3, the engine load and MAF rise and plateau. The CR decreases due to the adjustment of the VCR mechanism, lowering a height of the pistons, until the CR reaches a first threshold 914 at t3. The first threshold 916 may be a target CR that is determined by the controller to be a suitable CR for the current engine operating conditions. When the CR reaches the first threshold 914, the TPV is adjusted to the first position by deactivating the electromagnetic device. Oil flows in the forward direction, from the high pressure oil source to the oil chamber of the VCR mechanism and an increase in pressure in the oil chamber driving the locking pin into the first position to engage with the S-link. Upon insertion of the locking pin into an aperture of the S-link, the electric motor is turned off.

At t4, engine load decreases. The decrease in engine load may be due to engine operation during downhill navigation or a decreased demand for torque. MAF into the engine intake decreases as the amount of boosted air delivered by the turbocharger is reduced. The engine controller may command actions to increase the CR to reduce fuel consumption and increase a fuel economy of the VCR engine.

The electric device is activated and the TPV is adjusted to the second position at t5, venting oil from the oil chamber of the VCR mechanism to the low pressure oil reservoir, allowing the spring to disengage the locking pin from the S-link of the VCR mechanism. The spring pulls the locking pin into the second position, pushing remaining oil out of the oil chamber, and the electric motor is actuated to adjust the position of the S-link to adjust the height of the pistons to be increased. As the position of the S-link as altered, the CR rises between t5 and t6. At t6, the S-link is adjusted to align an aperture of the S-link with the locking pin at a position that modifies the height of the piston to a second threshold 916. The second threshold 916, set at a higher CR than the first threshold 914, is determined by the controller to be a CR suitable for the current engine operating conditions.

Upon reaching the second threshold 916, the electromagnetic device is instructed to turn off, shifting the TPV into the first position and allowing oil to flow in the forward direction from the high pressure oil source to the oil chamber of the VCR mechanism. The increased pressure in the oil chamber pushes the locking pin into the first position, engaging with the aperture of the S-link. The electric motor is deactivated once the locking pin is adjusted to the first position.

In this way, a VCR mechanism may adjust a compression ratio of an engine based on electric power provided by an electric actuator, and mechanically maintained at the compression ratio with assistance from a hydraulically-actuated locking mechanism as controlled by a two-position valve (TPV) directing flow of oil to and from the locking mechanism of the VCR mechanism. The VCR mechanism may include an S-link, coupled to a control shaft. The control shaft may be connected to a crankshaft that varies piston height within combustion chambers of the engine. Translational motion of the S-link, controlled by an electric motor, is converted into modification of the engine compression ratio, as determined by piston height. The VCR mechanism maintains the compression ratio by inserting, via hydraulic pressure, a locking pin into an aperture of the S-link, allowing the electric motor to be deactivated once the locking pin engages with the S-link. To change the compression ratio, the locking pin may be disengaged, also by hydraulic pressure, the electric motor may be activated, and the position of S-link may be adjusted to achieve a target piston height and compression ratio. By using the locking pin to maintain the compression ratio of the engine, the electric motor may be activated only when the compression ratio is to be adjusted, thereby decreasing an amount of energy consumed by the electric motor. Adjustment of the CR is electrically actuated while retention of the CR is enabled by utilizing hydraulic pressure to translate a locking pin that holds the VCR engine to a desired CR based on mechanical friction, thereby reducing a likelihood of slippage.

The technical effect of the configuring the engine with the VCR mechanism as disclosed herein is that a fuel economy of the engine is increased during load engine loads while sufficient power and mitigation of engine knock is provided during high engine loads.

In another representation, a method includes, upon receiving a command to vary a compression ratio of a VCR engine, adjusting a two-position valve to a first position and flowing oil in a first flow direction from a VCR mechanism to a low pressure oil source, and activating an electric motor to vary a position of an S-link of the VCR mechanism, and upon receiving a command to hold a compression ratio of the VCR engine, adjusting the two-position valve to a second position and flowing oil in a second flow direction from a high pressure oil source to the VCR mechanism, and deactivating the electric motor.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

In a first embodiment, a variable compression ratio mechanism includes an S-link including a plurality of apertures and coupled to a control shaft and attached to an electric motor, a locking pin configured to alternate between a first position and a second position, the locking pin inserted through an aperture of the plurality of apertures when in the first position, and a hydraulic device configured to selectively maintain the locking pin in the first position. In a first example, the electric motor actuates a translational motion of the S-link and the translational motion is converted into rotational movement of the control shaft. A second example of the mechanism optionally includes the first example and further includes wherein the plurality of apertures of the S-link are through-holes extending entirely through a thickness of the S-link and disposed along a length of the S-link, the length perpendicular to the thickness and parallel with a direction of the translational motion of the S-link. A third example of the mechanism optionally includes one or more of the first and second examples, and further includes wherein when the locking pin is moved into the first position, a first end of the locking pin is inserted through the aperture and into a non-moving component of a structure housing the VCR mechanism. A fourth example of the mechanism optionally includes one or more of the first through third examples and further includes, wherein when the locking pin is in the second position, the locking pin is not engaged with the aperture and the locking pin is positioned within an oil chamber of the hydraulic device. A fifth example of the mechanism optionally includes one or more of the first through fourth examples and further includes, wherein when the locking pin is in the first position, a spring in contact with a second end of the locking pin is extended and exerts an elastic force on the locking pin that is weaker than a hydraulic pressure on the locking pin exerted by oil in the oil chamber, and wherein the second end is opposite of the first end. A sixth example of the mechanism optionally includes one or more of the first through fifth examples and further includes, wherein when the locking pin is in the second position, the spring is contracted and the elastic force on the locking pin is greater than a hydraulic pressure in the oil chamber. A seventh example of the mechanism optionally includes one or more of the first through sixth examples and further includes, wherein the hydraulic device is energized electromagnetically and configured to slide between a first position when the hydraulic device is not energized and a second position when the hydraulic device is energized. An eighth example of the mechanism optionally includes one or more of the first through seventh examples and further includes, wherein when the hydraulic device is adjusted to the first position, the VCR mechanism is in the first position and when the hydraulic device is adjusted to the second position, the VCR mechanism in the second position.

In another embodiment, a method includes, responsive to a command to adjust a compression ratio of the VCR engine, releasing a locking pin configured to lock an S-link to a non-moving component of the VCR engine, and moving the S-link to rotate a control shaft coupled to a piston of the VCR engine, and upon the compression ratio being adjusted to a target compression ratio, locking the S-link to the non-moving component via the locking pin. In a first example, releasing the locking pin includes decreasing a hydraulic pressure in a chamber enclosing a portion of the locking pin. A second example of the method optionally includes the first example and further includes wherein decreasing the hydraulic pressure in the chamber comprises adjusting a position of a valve coupled to the chamber in order to fluidly couple the chamber to a low pressure hydraulic fluid source. A third example of the method optionally includes one or more of the first and second examples, and further includes wherein locking the S-link to the non-moving component includes increasing the hydraulic pressure in the chamber enclosing the portion of the locking pin. A fourth example of the method optionally includes one or more of the first through third examples, and further includes, wherein increasing the hydraulic pressure comprises adjusting the position of the valve coupled to the chamber to fluidly couple the chamber to a high pressure hydraulic fluid source. A fifth example of the method optionally includes one or more of the first through fourth examples, and further includes, wherein moving the S-link includes actuating an electric motor coupled to the S-link to move the S-link in a translational direction and converting the translational motion of the S-link is to rotational motion of the control shaft. A sixth example of the method optionally includes one or more of the first through fifth examples, and further includes, wherein rotating the control shaft comprises adjusting, via rotation of the control shaft, angles of flange bearings of a crankshaft, the crankshaft coupled to pistons of the VCR engine by connecting rods so that rotating the control shaft alters a height of the pistons, the height defined as a distance between piston tops and a cylinder head of the VCR engine. A seventh example of the method optionally includes one or more of the first through sixth examples, and further includes, wherein adjusting the compression ratio of the VCR engine in response to the command includes detecting a change in a speed of the VCR engine.

In another embodiment, a variable compression ratio engine includes a VCR mechanism including a control shaft, an S-link, and a locking pin, the VCR mechanism coupled to engine pistons by a crankshaft and coupled to a two-position valve, an electric motor connected to the S-link of the VCR mechanism, and a controller including memory with instructions stored thereon executable to adjust the two-position valve to disengage the locking pin from the S-link and activate the electric motor to move the S-link and rotate the control shaft to alter a height of the engine pistons in response to a detected change in engine speed, the height of the engine pistons corresponding to a compression ratio of the VCR engine, and adjust the two-position valve to engage the locking pin with the S-link and deactivate the electric motor upon detection that a target height of the engine pistons is attained. In a first example, the two-position valve is adjusted to fluidly couple the VCR mechanism to a low pressure oil source when the locking pin is disengaged from the S-link. A second example of the engine optionally includes the first example, and further includes wherein the two-position valve is adjusted to fluidly couple the VCR mechanism to a high pressure oil source when the locking pin is engaged with the S-link.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A variable compression ratio (VCR) mechanism coupled to engine pistons by a crankshaft, the VCR mechanism comprising; an S-link including a plurality of apertures and coupled to a control shaft and attached to an electric motor; a locking pin configured to alternate between a first position engaged with the S-link and a second position disengaged with the S-link, the locking pin inserted through an aperture of the plurality of apertures when in the first position; and a hydraulic device configured to selectively engage the locking pin with the S-link in the first position.

2. The VCR mechanism of claim 1, wherein the electric motor actuates a translational motion of the S-link and the translational motion is converted into rotational movement of the control shaft.

3. The VCR mechanism of claim 1, wherein the plurality of apertures of the S-link are through-holes extending entirely through a thickness of the S-link and disposed along a length of the S-link, the length perpendicular to the thickness and parallel with a direction of the translational motion of the S-link.

4. The VCR mechanism of claim 3, wherein when the locking pin is moved into the first position, a first end of the locking pin is inserted through the aperture and into a non-moving component of a structure housing the VCR mechanism.

5. The VCR mechanism of claim 4, wherein when the locking pin is in the second position, the locking pin is not engaged with the aperture and the locking pin is positioned within an oil chamber of the hydraulic device.

6. The VCR mechanism of claim 5, wherein when the locking pin is in the first position, a spring in contact with a second end of the locking pin is extended and exerts an elastic force on the locking pin that is weaker than a hydraulic pressure on the locking pin exerted by oil in the oil chamber, and wherein the second end is opposite of the first end.

7. The VCR mechanism of claim 6, wherein when the locking pin is in the second position, the spring is contracted and the elastic force on the locking pin is greater than a hydraulic pressure in the oil chamber.

8. The VCR mechanism of claim 1, wherein the hydraulic device is energized electromagnetically and configured to slide between a first position when the hydraulic device is not energized and a second position when the hydraulic device is energized.

9. The VCR mechanism of claim 8, wherein when the hydraulic device is adjusted to the first position, the VCR mechanism is in the first position and when the hydraulic device is adjusted to the second position, the VCR mechanism in the second position.

10. A method for a variable compression ratio (VCR) engine, comprising: responsive to a command to adjust a compression ratio of the VCR engine, releasing a locking pin from an aperture in configured to lock an S-link to unlock the S-link, and moving the S-link, via an electric motor, to rotate a control shaft coupled to a piston of the VCR engine to alter a height of the piston; and upon the compression ratio being adjusted to a target compression ratio, locking the S-link in a fixed position via the locking pin.

11. The method of claim 10, wherein releasing the locking pin includes decreasing a hydraulic pressure in a chamber enclosing a portion of the locking pin.

12. The method of claim 11, wherein decreasing the hydraulic pressure in the chamber comprises adjusting a position of a valve coupled to the chamber in order to fluidly couple the chamber to a low pressure hydraulic fluid source.

13. The method of claim 12, wherein locking the S-link to the non-moving component includes increasing the hydraulic pressure in the chamber enclosing the portion of the locking pin.

14. The method of claim 13, wherein increasing the hydraulic pressure comprises adjusting the position of the valve coupled to the chamber to fluidly couple the chamber to a high pressure hydraulic fluid source.

15. The method of claim 10, wherein moving the S-link includes actuating an electric motor coupled to the S-link to move the S-link in a translational direction and converting the translational motion of the S-link is to rotational motion of the control shaft.

16. The method of claim 10, wherein rotating the control shaft comprises adjusting, via rotation of the control shaft, angles of flange bearings of a crankshaft, the crankshaft coupled to pistons of the VCR engine by connecting rods so that rotating the control shaft alters a height of the pistons, the height defined as a distance between piston tops and a cylinder head of the VCR engine.

17. The method of claim 10, wherein adjusting the compression ratio of the VCR engine in response to the command includes detecting a change in a speed of the VCR engine.

18. A variable compression ratio (VCR) engine comprising;

a VCR mechanism including a control shaft, an S-link, and a locking pin, the VCR mechanism coupled to engine pistons by a crankshaft and coupled to a two-position valve;

an electric motor connected to the S-link of the VCR mechanism; and a controller including memory with instructions stored thereon executable to:

adjust the two-position valve to disengage the locking pin from the S-link and activate the electric motor to move the S-link and rotate the control shaft to alter a height of the engine pistons in response to a detected change in engine speed, the height of the engine pistons corresponding to a compression ratio of the VCR engine; and adjust the two-position valve to engage the locking pin with the S-link and deactivate the electric motor upon detection that a target height of the engine pistons is attained.

19. The VCR engine of claim 18, wherein the two-position valve is adjusted to fluidly couple the VCR mechanism to a low pressure oil source when the locking pin is disengaged from the S-link.

20. The VCR engine of claim 18, wherein the two-position valve is adjusted to fluidly couple the VCR mechanism to a high pressure oil source when the locking pin is engaged with the S-link.

* * * * *